US009752260B2

(12) United States Patent
Fujisawa et al.

(10) Patent No.: US 9,752,260 B2
(45) Date of Patent: Sep. 5, 2017

(54) BASE MATERIAL FOR ARTIFICIAL LEATHER AND PROCESS FOR PRODUCING THE SAME

(75) Inventors: Michinori Fujisawa, Okayama (JP); Jiro Tanaka, Okayama (JP); Norio Makiyama, Okayama (JP); Yoshiyuki Ando, Okayama (JP); Yoshiki Nobuto, Okayama (JP)

(73) Assignee: KURARAY CO., LTD., Kurashiki-shi (JP)

( * ) Notice: Subject to any disclaimer, the term of this patent is extended or adjusted under 35 U.S.C. 154(b) by 629 days.

(21) Appl. No.: 12/988,563

(22) PCT Filed: Jun. 25, 2008

(86) PCT No.: PCT/JP2008/061530

§ 371 (c)(1),
(2), (4) Date: Oct. 19, 2010

(87) PCT Pub. No.: WO2009/157063

PCT Pub. Date: Dec. 30, 2009

(65) Prior Publication Data

US 2011/0039055 A1 Feb. 17, 2011

(51) Int. Cl.

| | |
|---|---|
| ***D04H 3/105*** | (2012.01) |
| ***D04H 3/016*** | (2012.01) |
| ***D06N 3/00*** | (2006.01) |

(52) U.S. Cl.

CPC ..... *D04H 3/105* (2013.01); *D04H 3/016* (2013.01); *D06N 3/0004* (2013.01); *Y10T 428/2395* (2015.04); *Y10T 442/2352* (2015.04); *Y10T 442/613* (2015.04)

(58) Field of Classification Search

CPC ..... D04H 1/42; D04H 1/4382; D04H 3/00; D04H 3/015; D04H 3/016; D04H 3/018; D04H 13/001; D06N 3/00; D06N 3/0004; D06N 3/0015; D06N 3/04; D06N 3/144; D06N 3/0011; D06N 3/0013; D06N 3/0045; D06N 3/007; D06N 3/0075; D06N 3/0077; D06N 3/14; D06N 3/142; D06N 3/145; D06N 2211/28; D03D 15/00; D03D 15/0027; D03D 15/0061; D03D 15/0077; D03D 25/00; D03D 27/00; Y10T 442/2352; Y10T 442/613; Y10T 442/614; Y10T 428/2395; Y10T 428/24438

USPC ..... 442/340–351, 334, 335, 328, 329, 337, 442/363; 428/151, 218, 219, 220, 365, 428/903, 904

See application file for complete search history.

(56) References Cited

U.S. PATENT DOCUMENTS

| | | | | |
|---|---|---|---|---|
| 6,716,776 | B2 * | 4/2004 | Morishima et al. | 442/104 |
| 7,932,192 | B2 * | 4/2011 | Fujisawa et al. | 442/164 |
| 2001/0038901 | A1 * | 11/2001 | Morishima et al. | 428/105 |
| 2001/0053646 | A1 | 12/2001 | Tanaka et al. | |
| 2007/0166509 | A1 | 7/2007 | Horiguchi et al. | |
| 2009/0274862 | A1 * | 11/2009 | Nakayama et al. | 428/91 |

FOREIGN PATENT DOCUMENTS

| | | | |
|---|---|---|---|
| EP | 1 054 096 | A1 | 11/2000 |
| EP | 1 895 044 | A1 | 3/2008 |
| JP | 06173173 | A * | 6/1994 |
| JP | 2002-220741 | A | 8/2002 |
| JP | 2003-96676 | A | 4/2003 |
| JP | 2003-213575 | A | 7/2003 |
| JP | 2006-233393 | A | 9/2006 |
| JP | 2008-25041 | A | 2/2008 |
| TW | 200728551 | | 8/2007 |
| WO | WO 2007040144 | A1 * | 4/2007 |
| WO | WO 2007069628 | A1 * | 6/2007 |

OTHER PUBLICATIONS

U.S. Appl. No. 13/667,752, filed Nov. 2, 2012, Fujisawa, et al.
Taiwanese Office Action issued Aug. 5, 2013, in Patent Application No. 097123654.
Extended European Search Report issued in corresponding EP patent application 08790597.2 dated Jun. 12, 2014.
Korean Office Action dated Jun. 9, 2014, issued in corresponding Korean patent application No. 10-2010-7024509.

* cited by examiner

*Primary Examiner* — Frank Vineis
(74) *Attorney, Agent, or Firm* — Oblon, McClelland, Maier & Neustadt, L.L.P.

(57) ABSTRACT

A substrate for artificial leather comprising a nonwoven fabric of bundles of microfine filaments. The substrate for artificial leather simultaneously satisfies the following requirements 1 to 4: (1) the bundle of microfine filaments comprises 8 to 70 microfine filaments having a cross-sectional shape of nearly circle; (2) the bundle of microfine filaments has a cross-sectional area of 170 to 700 $\mu m^2$ and a flatness of 4.0 or less; (3) on a cross section parallel to a thickness direction of the nonwoven fabric body, cross sections of the microfine fiber bundles exist in a density of 1500 to 3000/$mm^2$; and (4) on a cross section parallel to a thickness direction of the nonwoven fabric body, gaps between the microfine fiber bundles have a size of 70 μm or less. By satisfying the requirements, the substrate for artificial leather combines high level of sensuous qualities and high level of physical properties which have been considered to be mutually exclusive.

13 Claims, No Drawings

BASE MATERIAL FOR ARTIFICIAL LEATHER AND PROCESS FOR PRODUCING THE SAME

CROSS-REFERENCE TO RELATED APPLICATIONS

This application is a National Stage of PCT/JP08/061530 filed Jun. 25, 2008.

TECHNICAL FIELD

The present invention relates to a substrate for artificial leather. By using the substrate for artificial leather, nap-finished artificial leather combining highly dense and elegant nap appearance, good color development, good surface abrasion resistance such as pilling resistance and soft hand with fullness, and grain-finished artificial leather combining highly flat and smooth surface with fine bent wrinkles, high bonding/peeling strength and soft hand with full feeling are obtained.

BACKGROUND ART

Nap-finished artificial leather such as suede-finished artificial leather and nubuck artificial leather which have a napped surface made of the fiber bundles on a substrate comprising fiber bundles and an elastic polymer has been known. The nap-finished artificial leather is required to fully satisfy a high level of physical properties such as fastness to light, pilling resistance and abrasion resistance, in addition to sensuous properties such as appearance (surface feeling closely resembling natural leather), hand (soft touch combined with moderate fullness and dense feeling), and color development (brilliantness and depth of color). To meet such requirements, there have been made various proposals.

To meet the requirement on the appearance and hand, for example, it has been generally employed to make artificial leather from microfine fibers. In the production of the artificial leather made of microfine fibers, it has been widely used to convert composite fibers such as sea-island fibers and multi-layered fibers to microfine fiber bundles by splitting or removal of a polymer component by decomposition or extraction. The nap-finished artificial leather and grain-finished artificial leather, which are made from a substrate for artificial leather comprising a nonwoven fabric of microfine fiber bundles derived from the composite fibers and an elastic polymer impregnated into the nonwoven fabric, are rated highly in their appearance and hand. However, such artificial leather involves a problem of lowering the color development as the fiber fineness is decreased, thereby to cause a remarkable deterioration in the brilliantness and depth of color. Particularly, the nap-finished artificial leather fails to meet a general requirement for high quality.

The nonwoven fabric for the substrate for artificial leather is generally produced by a method which includes a step of cutting spun fibers into staple fibers having a length of 100 mm or less, a step of making the staple fibers into a nonwoven web having a desired mass per unit area by a carding or paper making method, a step of optionally superposing two or more nonwoven webs, and a step of entangling the fibers by a needle-punching or spun-lacing method. Using the nonwoven fabric having a desired bulkiness and a degree of entanglement thus produced, the substrate for artificial leather is produced. The nap-finished artificial leather and grain-finished artificial leather produced from such a substrate for artificial leather are highly rated particularly in their hand. Although the staple fibers constituting the nonwoven fabric are fixed in the substrate by the entanglement between fibers and the impregnated elastic polymer, the staple fibers on the napped surface of nap-finished artificial leather or in the interface between the substrate and the grain layer of grain-finished artificial leather unavoidably tend to be easily pulled out or fallen from the nonwoven fabric because of their short length. With this tendency, the important surface properties such as the abrasion resistance of napped surface and the bonding/peeling strength of grain layer are reduced. To remove this problem, there have been generally employed to increase the degree of entanglement, bond the fibers with each other, or impregnate an elastic polymer in a large amount so as to strongly bind the fibers. However, the increase in the degree of entanglement and the use of an increased amount of elastic polymer in turn remarkably deteriorate the hand of artificial leather. Thus, it is difficult to satisfy the requirements for the appearance, hand and surface properties simultaneously.

To improve the surface abrasion resistance of nap-finished artificial leather, typically the pilling resistance of napped fibers, there has been proposed to produce suede-finished artificial leather by a method including a step of making a nonwoven fabric from sea-island fibers which are capable of being converted into bundles of microfine fibers of 0.8 D or less; a step of entangling the nonwoven fabric by needle punching; a step of immersing the entangled nonwoven fabric in an aqueous solution of polyvinyl alcohol (PVA) and then drying it to temporally fix the shape of the nonwoven fabric; a step of removing the sea component from the sea-island fibers by extraction using an organic solvent a step of impregnating a solution of polyurethane in dimethylformamide (DMF) and coagulating the polyurethane; and a step of raising the surface (Patent Document 1). It is also proposed to add coarse particles to the microfine fibers, the coarse particles having a particle size lager than a quarter of the fiber diameter and being inert to the fibers.

In Patent Document 2, it is proposed to produce suede-finished artificial leather by entangling a nonwoven fabric of sea-island fibers by needle punching; impregnating a solution of polyurethane in DMF into the entangled nonwoven fabric and coagulating the polyurethane; removing the sea component by extraction to obtain a leather-like substrate; and raising the obtained leather-like substrate. The fiber bundles constituting the substrate comprise fine fibers A of 0.02 to 0.2 D and microfine fibers B having a fineness of not more than ⅕ of the average fineness of the fine fibers A and less than 0.02 D. The ratio of the numbers of fibers (A/B) in fiber bundles is 2/1 to 2/3. The inside of fiber bundles is substantially free from an elastic polymer. The ratio of the number of fine fibers A and the number of the microfine fibers B (A/B) in the napped fibers is 3/1 or more.

There has been further proposed a method of improving the pilling resistance of suede-finished artificial leather, in which the foot of napped fibers is anchored by partially dissolving the elastic polymer around the foot of napped fibers using a solvent (Patent Document 3).

Patent Document 4 proposes a method of producing a nonwoven fabric of filaments which is capable of being converted into nubuck artificial leather having surface touch with fine texture. In the proposed method, the strain, which is characteristic of a nonwoven fabric of filaments and caused during the entangling treatment, is relieved by intentionally cutting the filaments during the entangling treatment by needle punching, thereby exposing the cut ends of fibers to the surface of nonwoven fabric in a density of 5 to 100/mm$^2$. It is also proposed to regulate the number of fiber bundles within 5 to 70 per 1 cm width on the cross section parallel to the thickness direction of nonwoven fabric, i.e., regulate the number of fiber bundles which are oriented by needle punching toward the thickness direction within 5 to 70 per 1 cm width. It is further proposed to regulate the total area of fiber bundles on a cross section perpendicular to the thickness direction of nonwoven fabric within 5 to 70% of the cross-sectional area.

Patent Document 5 proposes an entangled nonwoven fabric made of filaments which are capable of being converted into microfine fibers of 0.5 D or less, in which the percentage crimp of filaments is 10% or less and the nonwoven fabric contains the fibers in a density of 0.25 to 0.50 g/cm$^3$.

In the method of Patent Document 1, since the solution of polyurethane in DMF is impregnated and coagulated after removing the sea component of the sea-island fibers by extraction, the polyurethane penetrates into the inside of microfine fiber bundles, thereby making the hand hard. In addition, soft hand and touch are difficult to obtain because the coarse particles are added to the fibers.

In the method of Patent Document 2, since the solution of polyurethane in DMF is impregnated and coagulated before removing the sea component of sea-island fibers by extraction, the microfine fiber bundles are substantially free from the polyurethane on their outer surface and in their inside. Therefore, soft hand and touch are obtained. However, since the microfine fiber bundles are not fixed together by polyurethane, the pilling resistance is insufficient.

Patent Document 3 merely teaches to anchor the foot of napped fibers by partially dissolving the elastic polymer on the outermost surface of the leather-like substrate. Therefore, the fibers in the leather-like substrate are less fixed and the elastic polymer holds the fibers weakly. Therefore, the proposed method is not effective for improving the pilling resistance when the fineness is 0.01 dtex or more.

In the method of Patent Document 4 for obtaining the nonwoven fabric of filaments, the filaments are cut while preventing the properties from being made lower than intended. However, since a large number of filaments are actually cut, the advantages of filaments that the strength of nonwoven fabric is enhanced because of their continuity are reduced, thereby failing to effectively use their advantages. In Patent Document 4, the entangling treatment is not employed for entangling the filaments from the surface of nonwoven fabric of filaments, through the inside thereof, to the opposite surface, but employed for cutting the fibers on the surface of nonwoven fabric evenly to produce an extremely large number of cut ends as many as 5 to 100/mm$^2$. Therefore, the entangling treatment should be performed by needle punching under conditions far severer than generally used. With needle punching under such severe conditions, the fibers are difficult to be well entangled and a number of filaments are changed to staple fibers to produce a nonwoven fabric which is different from a nonwoven fabric of entangled filaments. Artificial leather made from the resulting nonwoven fabric has grade and quality resembling those of known artificial leather made from staple fibers. Therefore, artificial leather having a high grade intended in the present invention is difficult to obtain in the proposed nonwoven fabric.

By the method of Patent Document 5, a relatively densified nonwoven fabric of filaments may be obtained when presumed from the degree of fabric density However, since the densification is made only by needle punching and press, gaps with a size of about a hundred to several hundreds of micrometer are present throughout the nonwoven fabric. With such a nonwoven fabric, it is difficult to obtain a high grade artificial leather intended in the present invention. In more detail, a needle-punched nonwoven fabric generally has gaps with a size of about several hundreds of micrometer to several millimeters, although depending upon the fiber diameter and needle-punching conditions. When such a nonwoven fabric is pressed in the thickness direction while softening a component of fibers under heating, the solidification of the sea component and the fixation of the shape are merely caused, and gaps remain although collapsed in the thickness direction. When the sea component is removed, the fixation by the sea component is lost and the collapsed gaps restore to the original size. Thus, the resulting nonwoven fabric has a structure in which gaps having a size of about a hundred to several hundreds of micrometer are scattered therein.

[Patent Document 1] JP 53-34903A (pages 3 and 4)
[Patent Document 2] JP 7-173778A (pages 1 and 2)
[Patent Document 3] JP 57-154468A (pages 1 and 2)
[Patent Document 4] JP 2000-273769A (pages 3 to 5)
[Patent Document 5] JP 11-200219A (pages 2 and 3)

DISCLOSURE OF INVENTION

It has been hitherto difficult to provide a nap-finished artificial leather which simultaneously combines an elegant and dense nap appearance and color development of napped microfine fibers; soft fullness and dense feeling; or soft touch of the surface having napped microfine fibers and surface abrasion resistance such as pilling resistance. In the grain-finished artificial leather, it has been difficult to simultaneously combine the balance between a grain layer and a substrate, for example, the balance between hard properties for creating a highly smooth surface with fine bent wrinkles and soft properties for creating uniformity with a highly soft substrate; a grain layer with soft fullness and dense feeling and hand of substrate; or soft hand due to high softness of substrate and surface mechanical properties such as a bonding/peeling strength at the interface between the grain layer and the substrate.

An object of the present invention is to provide a substrate for artificial leather combining high level of sensuous properties and high level of physical properties, although these properties are hitherto recognized as antinomic in the art of substrate for artificial leather. Using the substrate of the present invention, artificial, leather combining a higher quality and higher properties than ever achieved are obtained.

As a result of extensive study in view of achieving the above object, the inventors have reached the present invention. Namely, the present invention relates to a substrate for artificial leather comprising a nonwoven fabric made of bundles of microfine filaments, which simultaneously satisfies the following requirements 1 to 4:

(1) the bundle of microfine filaments comprises 8 to 70 microfine filaments having a cross-sectional shape of nearly circle;
(2) the bundle of microfine filaments has a cross-sectional area of 170 to 700 μm$^2$ and a flatness of 4.0 or less;
(3) on a cross section parallel to a thickness direction of the nonwoven fabric, cross sections of the microfine fiber bundles exist in a density of 1500 to 3000/mm$^2$; and
(4) on a cross section parallel to a thickness direction of the nonwoven fabric, gaps between the microfine fiber bundles have a size of 70 μm or less.

The present invention further relates to a method of producing a substrate for artificial leather, the method comprising the following sequential steps (a) to (d):

(a) melt-spinning sea-island filaments having an island number of 8 to 70, a sea/island cross-sectional area ratio of 5:95 to 60:40 and a cross-sectional area of 70 to 350 $\mu m^2$ using a heat-shrinkable polymer as an island component and a water-soluble polymer as a sea component, and collecting the spun sea-island filaments on a collecting surface in random orientations without cutting, thereby producing a sheet-form web of filaments;

(b) after optionally superposing the web of filaments in layers, needle-punching the web of filaments from both sides thereof using at least needles with six barbs while allowing at least one barb to penetrate through the web of filaments, thereby three-dimensionally entangling the sea-island filaments to produce a nonwoven fabric;

(c) moist heat-treating the nonwoven fabric to plasticize the sea component polymer and allow the island component polymer to shrink and then optionally pressing the nonwoven fabric under dry heating, thereby densifying the nonwoven fabric such that cross sections of the sea-island filaments exist 1000 to 3500/$mm^2$ on a cross section parallel to a thickness direction of the nonwoven fabric body; and (d) removing the sea component from the sea-island filaments by water or an aqueous solution, thereby converting the sea-island filaments to bundles of microfine filaments.

Since the microfine fiber bundles are compacted together more closely than ever known, the substrate for artificial leather of the present invention is extremely highly densified and has an extremely flat and smooth surface. By using such a substrate for artificial leather, it is possible to produce nap-finished, artificial leather having smooth, elegant appearance and touch which are equal to and competitive with those of natural leather and also being excellent in the color development, hand with fullness and surface abrasion resistance such as pilling resistance. It is also possible to produce grain-finished artificial leather having smooth, soft hand with fullness which is equal to and competitive with that of natural leather and an excellent surface strength such as the bonding/peeling strength.

BEST MODE FOR CARRYING OUT THE INVENTION

The substrate for artificial leather of the present invention is produced, for example, by carrying out the following steps (a) to (d) sequentially.

Step (a)

The sea-island filaments are melt-spun by extruding a sea component polymer and an island component polymer from a composite-spinning spinneret while using a heat-shrinkable polymer as the island component and a water-soluble polymer as the sea component.

The composite-spinning spinneret preferably has a structure having arrays of nozzles, which are disposed in parallel. In each array, the nozzles are arranged in a straight row. With such a structure, a cross section in which 8 to 70 islands of the island component polymer are dispersed in the sea component polymer is obtained.

The sea component polymer and the island component polymer are extruded from the spinneret at a spinneret temperature of 180 to 350° C. while regulating the relative feeding amounts of the polymers and the feeding pressure such that the area ratio (i.e., volume ratio of the polymers) of the sea component polymer and the island component polymer on the cross section of the fibers being produced falls within a range of 5/95 to 60/40.

The cross-sectional area of the sea-island filaments is 70 to 350 $\mu m^2$. The single fiber fineness is preferably 0.9 to 4.9 dtex and more preferably 1.9 to 3.9 dtex when the island component polymer is polyethylene terephthalate and the sea component polymer is a water-soluble thermoplastic polyvinyl alcohol, although depending upon the area ratio of the compounded polymers.

The melt-spun sea-island filaments are collected on a collecting surface such as net in random directions without cutting, thereby producing a web of filaments having a desired mass per unit area (preferably 10 to 1000 g/$m^2$).

Step (b)

The web of filaments thus obtained, optionally after superposed in two or more layers by a crosslapper, is then needle-punched by needles having at least 6 barbs from both surfaces thereof simultaneously or alternately while allowing at least one barb to penetrate through the web of filaments, thereby three-dimensionally entangling the fibers. Thus, a nonwoven fabric in which the sea-island fibers exist on a cross section parallel to the thickness direction of the nonwoven fabric in a density of 400 to 2000/$mm^2$, and the sea-island filaments are extremely closely compacted is obtained. An oil agent may be added to the web of filaments at any stage after its production and before the entangling treatment. The oil agent is selected from an antistatic oil agent, an oil agent for controlling the frictional resistance between fiber and needle, and an oil agent for controlling the frictional resistance between fibers. These oil agents may be used alone or in combination of two or more.

Step (c)

The nonwoven fabric obtained in the step (b) is closely compacted by the moist heat treatment in which the nonwoven fabric is introduced into a moist heat atmosphere which allows the sea component polymer to plasticize and the island component polymer to shrink, optionally followed by a hot-press treatment until the number of cross sections of the sea-island filaments reaches 1000 to 3500/$mm^2$ on the cross section of the nonwoven fabric parallel to its thickness direction. The moist heat treatment is conducted by a method in which the nonwoven fabric is introduced into an atmosphere continuously supplied with saturated water vapor, a method in which water is added to the nonwoven fabric in an amount sufficient for the sea component polymer to swell and plasticize in a desired degree and then the water in the nonwoven fabric is heated by a hot air or electromagnetic wave such as infrared ray, or a combination thereof. In addition to the effect of densifying the fiber structure, the hot-press treatment may have additional effects of fixing the shape of the nonwoven fabric and flattening and smoothing its surface.

The average apparent density of the nonwoven fabric after the densifying treatment of the step (c) is preferably 0.3 to 0.8g/$cm^3$, when the island component polymer is polyethylene terephthalate and the sea component polymer is a water-soluble, thermoplastic polyvinyl alcohol. The average apparent density is determined under a condition free from a compressing load, for example, by the observation of cross section under electron microscope. The mass per unit area of the nonwoven fabric is preferably 100 to 2000 g/$m^2$.

Step (d)

The sea component polymer is removed from the sea-island filaments constituting the nonwoven fabric by extraction with water or an aqueous solution, to convert the sea-island filaments into microfine fiber bundles.

By subjecting the substrate for artificial leather obtained above to the following sequential steps (e) to (h), a substrate for artificial leather more suitable for the production of a suede or nubuck napped artificial leather having the effects intended in the invention and the appearance and touch which are comparable to those of natural leather is obtained.

Step (e)

A solution, aqueous dispersion or melt of an easily extractable polymer is applied on at least one surface of the nonwoven fabric and then the easily extractable polymer is coagulated.

Step (f)

An aqueous dispersion of an elastic polymer is applied on the same surface and then the elastic polymer is coagulated.

Step (g)

The easily extractable polymer is removed from the nonwoven fabric body.

Step (h)

The surface applied with the elastic polymer is ground under pressure to densify the nonwoven fabric such that the gaps between the microfine fiber bundles in the region from the ground surface to a depth of 200 μm on a cross section of the nonwoven fabric parallel to its thickness direction have an average size of 10 to 40 μm, In the above method of producing the substrate for artificial leather, by conducting the optional step (i) before or after the step (d), a substrate for artificial leather more suitable for the production of a grain-finished artificial leather having the effect intended in the invention and a good hand attributable to the united coating layer is obtained.

Step (i)

A solution or aqueous dispersion of the elastic polymer is impregnated into the nonwoven fabric and then the elastic polymer is coagulated.

The means for achieving the present invention will be described in more detail.

The sea-island fibers for constituting the nonwoven fabric are multi-component composite fibers made of at least two kinds of polymers. In the cross section of such composite fibers, a kind of island component polymer is distributed in a different kind of sea component polymer which constitutes mainly the outer peripheral portion of fibers. By suitably selecting the ratio of the sea component polymer and the island component polymer, the island component polymer is distributed in nearly circular cross-sectional shapes by the action of surface tension. The term "nearly circular shape" used herein includes circular shape, polygonal shape nearly circular, and elliptical shape nearly circular. At a suitable stage after forming a nonwoven fabric with a desired dense structure or at a suitable stage before or after impregnating an elastic polymer if it is used, the sea component polymer is removed by extraction or decomposition, thereby converting the sea-island fibers into bundles of fibers which are made of the island component polymer and thinner than the sea-island fibers. Such sea-island fibers are produced by a known spinning method for multi-component composite fibers such as a chip blend method (mix spinning) and a composite spinning method. As compared with split/division-type composite fibers having a petaline or layered cross section in which the peripheral portion of fibers is alternately formed from different components, the sea-island fibers quite little cause fiber damages such as cracking, folding and breaking during the fiber entangling treatment such as a needle punching treatment, because the outer periphery of the sea-island fibers is mainly formed from the sea component polymer. Therefore, the degree of densification due to entanglement can be enhanced. As compared with split/division-type composite fibers, the sea-island fibers are less anisotropic in the plane perpendicular to the fiber axis and give bundles of microfine fibers each having a highly uniform fineness, i.e., a highly uniform cross-sectional area. Therefore, a nonwoven fabric made of a large number of fiber bundles which are compacted more closely than ever achieved is obtained. Therefore, in the present invention, the nonwoven fabric is produced from sea-island fibers so as to obtain such effects which cannot be achieved by split/division-type composite fibers having a petaline or layered cross section.

It is important to use a heat-shrinkable polymer as the island component of the sea-island fibers. Preferred examples thereof include known fiber-forming, heat-shrinkable polymers such as polyester resins, for example, polyethylene terephthalate (PET), polytrimethylene terephthalate (PTT), polybutylene terephthalate (PBT), polyester elastomers and their modified products; heat-shrinkable polyimide resins; and heat-shrinkable polyolefin resins and their modified products. Of these polymers, the polyester resins such as PET, PTT, PBT, and modified polyesters thereof are particularly preferred. By the heat shrinking of the polyester resin, the substrate for artificial leather intended in the invention comprising the nonwoven fabric in which the microfine fiber bundles are closely compacted is obtained. Such a substrate for artificial leather is made into artificial leather products having good sensuous qualities such as dense surface and dense feeling, and good practical performances such as abrasion resistance, fastness to light and shape stability. The island component polymer is preferably a polymer having a melting point (Tm) of 160° C. or higher, and more preferably a fiber-forming, crystallizable resin having Tm of 180 to 330° C. If Tm is less than 160° C., the shape stability of the obtained microfine fibers fails to reach the level aimed in the present invention. Particularly, such polymer is unfavorable in view of the practical performances of processed artificial leather products. In the present invention, the melting point is the peak top temperature of the endothermic peak of the polymer which is observed when heating a polymer from room temperature to a temperature of from 300 to 350° C. according to the kind of polymer at a rate of 10° C./min in a nitrogen atmosphere, immediately cooling to room temperature, and then, heating again to a temperature of from 300 to 350° C. at a rate of 10° C./min using a differential scanning calorimeter (DSC). The microfine fibers may be added with colorant, ultraviolet absorber, heat stabilizer, deodorant, fungicidal agent, antimicrobial agent and various stabilizer at the spinning stage.

It is important to use a water-soluble polymer as the sea component of the sea-island fibers. Since the sea-island fibers are converted to microfine fiber bundles, the sea component polymer is required to have solubility to solvent or decomposability by decomposer different from those of the island component polymer to be combinedly used. In view of the spinning stability, the sea component polymer is preferably less compatible with the island component polymer, and its melt viscosity or surface tension is preferably smaller than those of the island component polymer under the spinning conditions. Preferred examples of the sea component polymer include water-soluble polymers such as polyvinyl alcohol, polyethylene glycol, polyesters modified by copolymerizing a compound having alkali metal sulfonate, and polyethylene oxide. Most preferred examples include polyvinyl alcohol resin (PVA) such as polyvinyl alcohol homopolymer and polyvinyl alcohol-based copolymer. The water-soluble polymer referred to herein is a polymer which can be removed by dissolution or decomposition by water, an aqueous alkaline solution or an aqueous acidic solution under heating or pressure. By using the water-soluble polymer as the sea component, the sea component polymer is quickly swelled and plasticized and the shrinking of the island component polymer is little inhibited, thereby allowing the production of the substrate for artificial leather intended in the invention comprising the nonwoven fabric in which the microfine fiber bundles are closely compacted, which can be made into artificial leather products having good sensuous qualities such as dense surface and dense feeling and good practical performances such as abrasion resistance, fastness to light and shape stability.

PVA is produced by saponifying a resin mainly constituted by vinyl ester units. Examples of vinyl monomers for the vinyl ester units include vinyl formate, vinyl acetate, vinyl propionate, vinyl valerate, vinyl caprate, vinyl laurate, vinyl stearate, vinyl benzoate, vinyl pivalate and vinyl versatate, with vinyl acetate being preferred in view of easy production of PVA.

PVA may be a homo PVA or a modified PVA introduced with co-monomer units, with the modified PVA being preferred in view of a good melt spinnability, water solubility and fiber properties. By suitably selecting the co-monomer for modification, the sea-island fibers are stably produced without reducing the water solubility of PVA. In view of a good copolymerizability, melt spinnability and water solubility of resulting fibers, preferred examples of the co-monomers are α-olefins having 4 or less carbon atoms such as ethylene, propylene, 1-butene and isobutene; and vinyl ethers such as methyl vinyl ether, ethyl vinyl ether, n-propyl vinyl ether, isopropyl vinyl ether and n-butyl vinyl ether. The content of the comonomer units in PVA is preferably 1 to 20 mol %, more preferably 4 to 15 mol %, and still more preferably 6 to 13 mol %. Particularly preferred is an ethylene-modified PVA, because the fiber properties are enhanced when the comonomer unit is ethylene. The content of the ethylene units in the ethylene-modified PVA is preferably 4 to 15 mol % and more preferably 6 to 13 mol %.

PVA is produced by a known method such as bulk polymerization, solution polymerization, suspension polymerization, and emulsion polymerization, with the bulk polymerization or solution polymerization in the absence or presence of a solvent such as alcohol being generally employed. Examples of the solvent for the solution polymerization include lower alcohols such as methyl alcohol, ethyl alcohol and propyl alcohol. The copolymerization is performed in the presence of a known initiator, for example, an azo initiator or peroxide initiator such as a,a'-azobisisobutyronitrile, 2,2'-azobis(2,4-dimethyl-varelonitrile), benzoyl peroxide, and n-propyl peroxycarbonate. The polymerization temperature is not critical and a range of from 0 to 150° C. is recommended.

The viscosity average polymerization degree (hereinafter simply referred to as "polymerization degree") of PVA is preferably 200 to 500, more preferably 250 to 470, and still more preferably 300 to 450. If being 200 or more, the melt viscosity is high enough to stably form the composite fibers. If being 500 or less, the melt viscosity is low enough to make the extrusion from a spinning nozzle easy. Another advantage of using PVA having a polymerization degree of 500 or less, i.e., a low-polymerization degree PVA is that the dissolution speed in the removal operation by water or an aqueous solution is increased. The polymerization degree of PVA is determined according to JIS-K6726 from the following equation:

$$P=([\eta]\times10^3/8.29)^{(1/0.62)}$$

wherein P is the viscosity average polymerization degree and [η] is the intrinsic viscosity of PVA measured in water at 30° C. after re-saponifying and purifying PVA.

The saponification degree of PVA is preferably 90 to 99.99 mol %, more preferably 93 to 99.77 mol %, still more preferably 95 to 99.55 mol %, and particularly preferably 97 to 99.33 mol %. If being 90 mol % or more, the heat stability is good and the thermal decomposition and gelation during the melt spinning are little caused. If being 99.99 mol % or less, PVA is stably produced.

Tm of PVA is preferably 160° C. or higher, more preferably 170 to 230° C., still more preferably 175 to 225° C., and particularly preferably 180 to 220° C. If being 160° C. or higher, the reduction of fiber strength due to the decrease in the crystallizability is avoided and the heat stability of PVA is good to make the fiber formability good. If being 230° C. or lower, the melt spinning can be performed at temperatures sufficiently lower than the decomposition temperature of PVA and the microfine fiber bundle-forming filaments are stably produced.

The content of sea component polymer in the sea-island fibers is 5 to 60% and preferably 10 to 50% when expressed by the area ratio determined on fiber cross section. If the content is less than 5%, the industrial productivity is poor because the spinning stability of sea-island fibers is lowered. In addition, since the amount of the sea component is small, the effect for reducing the friction or interaction between the island components during the moist heat-shrinking of the sea-island fibers may be insufficient, thereby failing to obtain the intended shrinking and densification. Further, when a solution or aqueous dispersion of elastic polymer is impregnated into the nonwoven fabric and solidified therein, a sufficient amount of gaps is not formed between the microtine fiber bundle and the elastic polymer by the removal of the sea component. Therefore, the bulky feeling, dense feeling, and compact surface intended in the invention are hardly obtained. If the content exceeds 60%, the shape and distribution of the island component on the cross section of the sea-island fibers are uneven, to deteriorate the quality. In addition, the intended shrinking and densification is not obtained in some cases during the moist heat-shrinking of the sea-island fibers because the sea-island fibers are relatively deficient in the shrinkable island component. Therefore, the effect of the invention is also difficult to obtain. The amount of the microfine fibers in the substrate for artificial leather after removing the sea component decreases with increasing content of the sea component polymer. Therefore, an increased content of the sea component polymer remarkably increases the amount of elastic polymer to be used for obtaining a desired level of shape stability. In addition, the energy consumption for recovering the removed sea component polymer is high to increase the industrial production costs and the load on global environment is also increased. Therefore, the content of the sea component polymer is preferably set as low as possible as long as the requirements mentioned above are satisfied.

In the present invention, sea-island filaments are used. The filaments are the fibers which are not intentionally cut as so done in the production of staple fibers generally having a length of about 10 to 50 mm. The length of filaments is not particularly specified. In view of obtaining the effect of the invention, the length of the filaments before converted to microfine fibers is preferably 100 mm or longer, and may be several meters, hundreds of meter, or several kilo-meters as long as being technically possible to produce or being not physically broken.

The sea-island fibers are spun by using a composite-spinning spinneret. The spinneret has a number of arrays of nozzles disposed in parallel or a number of circles of nozzles disposed concentrically. In each array or circle, the nozzles are arranged at equal spaces. Each nozzle has 8 to 70 flow paths for the island component polymer in average and the flow paths for the sea component polymer which surround the flow paths for the island component polymer. The molten sea-island composite fibers comprising the sea component polymer and island component polymer are continuously extruded from each nozzle. The extruded molten composite fibers are uniformly made finer by pulling to an intended fineness by air jet using a sucking apparatus such as air jet nozzle, while substantially solidifying the molten composite fibers by a cooling air at any place between the nozzle and the sucking apparatus. The air jet speed is selected so that the average spinning speed, which corresponds to the mechanical take-up speed used in a general spinning method, is 1000 to 6000 m/min. The composite fibers are then collected and piled on a collecting surface such as a conveyer belt-like moving net by sucking from the surface opposite to the collecting surface, while opening the composite fibers by an impact plate or air flow according to the texture of fiber web being obtained, thereby forming a web of filaments.

When the composite-spinning spinneret is of a concentric arrangement, one nozzle-type sucking apparatus is generally used per one spinneret. Therefore, a number of sea-island fibers are gathered to the center of the concentric circles. Since the spinnerets are generally disposed in line to obtain a desired spinning amount, fibers are substantially not present between the bundles of sea-island fibers which are extruded from adjacent spinnerets. Therefore, it is important to open the fibers to make the texture of fiber web uniform. When the composite-spinning spinneret is of a parallel arrangement, a sucking apparatus having a linear slit which is disposed opposite to the spinneret is used. Therefore, since the sea-island fibers from arrays of nozzles arranged in parallel are gathered by suction, a fiber web having a more uniform texture is obtained, as compared with using a composite-spinning spinneret of a concentric arrangement. Therefore, the parallel arrangement is preferred to the concentric arrangement.

The obtained web of filaments is then preferably press-bonded by pressing or embossing under partial heating or cooling according to the shape stability desired in the later steps. When the melt viscosity of the sea component polymer is smaller than that of the island component polymer, by heating or cooling at 60 to 120° C. without heating to temperature as high as the melting temperature, the web of filaments can retain its texture sufficiently in the later steps without serious damage in the cross-sectional shape of the sea-island fibers constituting the web of filaments. In addition, the shape stability of the web of filaments can be enhanced to a level sufficient for winding-up.

The known method generally employed in the production of artificial leather which includes a step of producing a fiber web of staple fibers using a carding machine requires, in addition to a carding machine, a series of large apparatuses for providing an oil agent and crimping to make the fibers to easily pass a carding machine, for cutting the fibers into a desired length, and for transporting and opening raw fibers after cutting, and therefore, is unfavorable in view of production speed, stable production and costs, Another method using staple fibers is a paper-making method. This method also needs an additional apparatus for cutting and involves the same problems as in the above methods. In addition, the mass per unit area of the nonwoven fabric obtainable in this method is about 200 g/m$^2$ at the largest, this limiting the application of resulting artificial leather products. As compared with the methods using staple fibers, the production method of the present invention uses an extremely compact and simplified apparatus because the process from the spinning through the production of fiber web is continuously conducted in a single step, and therefore, is excellent in production speed and costs. In addition, the production method of the present invention is excellent in stable production, because it is free from the problems involved in the known methods, which are attributable to the combination of steps and apparatuses. As compared with the nonwoven fabric of staple fibers in which the fibers are bound only by entanglement and impregnation of elastic polymer, the nonwoven fabric of filaments and the substrate for artificial leather or artificial leather made therefrom are excellent in the mechanical strength such as shape stability and properties such as surface abrasion resistance and bonding/peeling strength of grain layer.

The production method of the present invention enables the use of extremely fine fibers which are difficult to be used in the known methods using a carding machine and does not need to crimp fibers. Therefore, the fibers are prevented from being bulky and a nonwoven fabric more densified than ever is stably obtained even at the stage of mechanically collecting the spun fibers. By combining the method described below, artificial leather having an extremely high quality not realized ever can be obtained.

In the known production of a nonwoven fabric from staple fibers, a certain level or more fiber diameter which is acceptable to an opening apparatus and a carding machine is needed. Specifically, a cross-sectional area of 200 μm$^2$ or more is required and fibers having a cross-sectional area of about 300 to 600 μm$^2$ are generally used in view of the stable industrial production. In the production method of the present invention, since the cross-sectional area of fibers is not limited by the apparatus, extremely fine fibers having a cross-sectional area of as finer as 100 μm$^2$ or less are usable. In view of obtaining the densified structure of nonwoven fabric intended in the invention, the cross-sectional area is required to be 70 to 350 μm$^2$, and preferably 80 to 300 μm$^2$ in view of the shape stability and handling ability in the subsequent steps. By using filaments having such a cross-sectional area, a web of filaments having a fiber distribution in which on the cross section of the fiber web taken parallel to the thickness direction thereof the cross sections of fibers nearly perpendicular to the cross section of the fiber web exist in an average existence density of 100 to 600/mm$^2$, preferably 150 to 500/mm$^2$ is obtained. With such a fiber distribution, the densified nonwoven fabric of the present invention is finally obtained through the subsequent entanglement, shrinking, etc.

In the present invention, the denseness of nonwoven fabric constituting the resulting substrate for artificial leather is important, particularly the nonwoven fabric constituting the surface portion of the substrate for artificial leather is required to be densified. Therefore, the cross-sectional area of bundles of microfine filaments formed by removing the sea component polymer from the sea-island fibers is required to be 700 μm$^2$ or less. The cross-sectional area of 700 μm$^2$ or less corresponds to about 10 dtex or less of fineness of the microfine fiber bundles when the microfine filaments are made of polyethylene terephthalate. To obtain a substrate for artificial leather capable of producing a nap-finished artificial leather with extremely high quality and a grain-finished artificial leather with fine bent wrinkles, the densified structure of the nonwoven fabric obtained by the fiber bundles having such a fineness is required. When a nubuck artificial leather having napped microfine staple fibers and dense surface feeling is required, the cross-sectional area of bundles of microfine filaments is preferably 500 $\mu m^2$ or less and more preferably 400 $\mu m^2$ or less. As compared with the upper limit of the cross-sectional area of bundles of microfine filaments, the lower limit thereof does not so affect the properties of substrate for artificial leather. However, the strength and surface abrasion resistance of the artificial leather may be significantly reduced in some cases, if the cross-sectional area is excessively small. In view of avoiding this problem and the process limitations on the production of artificial leather, the cross-sectional area of the bundles of microfine filaments is 170 $\mu m^2$ or more, preferably 180 $\mu m^2$ or more, and still more preferably 190 $\mu m^2$ or more.

The number of microfine filaments constituting one microfine fiber bundle is 8 or more in view of easy bending of the bundles of microfine filaments, i.e., in view of easy entangling thereof in the nonwoven fabric and the easy bending of the finally obtained substrate for artificial leather, and 70 or less in view of the easy bending of the bundles of microfine filaments, the deformability of the cross sectional shape, and the color developability of the finally obtained substrate for artificial leather. The number of microfine filaments is preferably 10 to 60 and more preferably 12 to 45. If the number is 7 or less, the bundles of microfine filaments are not easily bent as well as the number of microfine filaments bound by the elastic polymer impregnated into the nonwoven fabric body, i.e., the ratio of the number of microfine filaments positioned at the outer periphery of the bundle to the number of microfine filaments constituting the bundle is increased. This causes that the easy bending of the bundles of microfine filaments is likely to be reduced by the elastic polymer and the hand easily becomes hard even in a small amount of the elastic polymer. Therefore, the unevenly impregnated elastic polymer is likely to appear as the uneven hand of the substrate for artificial leather, thereby significantly reducing the value of industrial products. If the number of microfine filaments exceeds 70, each of the microfine filaments is easily bent, but the easy bending of bundles are rather reduced provably because of the offset clue to the increased contact surface between the microfine filaments. In addition, the cross sectional shapes of bundles of microfine filaments may be easily deformed by the compressing force from the direction perpendicular to the fiber axis, i.e., the bundles may become flat. In addition, since the space between the fibers is wide, the bundles are easily loosened and become bulky; thereby limiting the densified degree of the nonwoven fabric body. The sea-island fibers also involve the problem of bulkiness. When the cross sectional shape of fibers is easily flattened, the cross-sectional filling degree of fibers constituting the nonwoven fabric becomes low, thereby preventing the densification at the stage before removing the sea component.

Therefore, the number of fibers in each bundle is required to be 70 or less so as to make the bundles difficult to be flattened. The flatness of the bundles of microfine filaments in the finally obtained substrate for artificial leather is required to be 4.0 or less, preferably 3.0 or less. Since the disadvantage caused by the flattened bundles of microfine filaments is particularly remarkable on the surface of the substrate for artificial leather, the width of the bundles viewed from the upper side of the surface, i.e., the projected size of the bundles of microfine filaments is preferably 10 to 60 μm and more preferably 15 to 45 μm. If exceeding 60 μm, the bundles are little densified and therefore the number of bundles capable of forming naps is reduced to result in a nap-finished artificial leather having a napped surface with poor appearance. If less than 10 μm, the bundles can be very easily densified. However, even if the bundles are not flattened at all, the bundles are frequently broken during the napping treatment for the production of the nap-finished artificial leather, because the bundles with a size of less than 10 μm are very thin. Therefore, the appearance is poor and the abrasion resistance of surface is also poor.

If the bundles of microfine filaments have the properties mentioned above, a fiber assembly having an extremely densified structure not achieved ever is obtained, in which the cross section of bundles of microfine filaments nearly perpendicular to a cross section taken parallel to the thickness direction of the nonwoven fabric constituting the substrate for artificial leather exists on the cross section in a density of as large as 1500 to 3000/$mm^2$. If less than 1500/$mm^2$, the space where no microfine fiber bundles exist is left much, corresponding to a low existence density of microfine fiber bundles. In addition, if the existence density is low, the microfine fiber bundles are not distributed uniformly, but may be distributed separately in a dense region including closely compacted bundles and a sparse region including few bundles. Further, if the space between the microfine fiber bundles is broad, the elastic polymer forms a continuous thick film. Therefore, the hand of the resulting artificial leather is hard and the surface appearance and surface properties are poor because of extremely large dense-sparse unevenness. If exceeding 3000/$mm^2$, a fiber assembly apparently more densified than the substrate for artificial leather of the invention is obtained. However, the obtained densified structure is merely achieved by forcedly compressing the nonwoven fabric in its thickness direction by hot press, etc., or merely achieved by forcedly compressing the nonwoven fabric in its lengthwise direction or widthwise direction by the shrinking force of the shrinkable woven or knitted fabric bonded to the nonwoven fabric body. Therefore, the microtine fiber bundles are collapsed and flattened in the compressed direction, and the properties are deteriorated and the hand becomes hard. The existence density is preferably 2000 to 2700/$mm^2$.

In the production of a substrate for artificial leather using a known nonwoven fabric body, the nonwoven fabric to be densified by entanglement, etc. is constituted by thick fibers which are converted to microfine fiber bundles having a cross-sectional area of as large as 300 to 600 $\mu m^2$. Therefore, the nonwoven fabric is not sufficiently densified before the conversion to microtine fiber bundles. When such a nonwoven fabric is subjected to the conversion to microfine fiber bundles, the obtained existence density of the cross section of microfine fiber bundles is not more than about 200 to 600/$mm^2$ and about 750/$mm^2$ at the highest. If it is attempted to obtain a nonwoven fabric having an existence density of microfine fiber bundles exceeding 750/$mm^2$ by a conventional technique, bundles are damaged by an excessive needle punching treatment, or the cross-sectional shape of bundles are largely deformed, as mentioned above, by a forcible compression by hot press. Alternatively, the densification only by such treatments leads to significantly uneven gaps between bundles to provide a substrate for artificial leather quite different from that intended in the present invention. If the known nonwoven fabric having an existence density of bundles of 200 to 600/$mm^2$ at the highest is impregnated with an elastic polymer, the elastic polymer forms a continuous thick film between the microfine fiber bundles because of the low existence density of bundles, although depending upon the impregnation amount. Therefore, the hand of the composite structure of the nonwoven fabric and the elastic polymer becomes harder than expected, and a composite structure with an extremely large dense-sparse unevenness is only obtained, in which the region with closely compacted fibers or elastic polymer and the region with little fibers and elastic polymer are interspersed in places. In contrast, since the microfine fiber bundles are assembled extremely densely and uniformly in the nonwoven fabric of the invention, the continuous film formed between the microfine fiber bundles by the elastic polymer impregnated into the nonwoven fabric can be made thinner, in addition, the cells surrounded by the elastic polymer is smaller and uniformly distributed. Therefore, the remarkable sparse-dense unevenness in the substrate for artificial leather is prevented.

The diameter of the microfine filaments is not particularly limited as long as the nonwoven fabric is formed by the bundles of microfine filaments satisfying the requirements mentioned above. To obtain the napped surface with elegant appearance and touch intended in the present invention, the diameter of the microfine filaments at least in the napped portion is preferably 0.8 to 15 μm, more preferably 1.0 to 13 μm, particularly preferably 1.2 to 10 μm, and most preferably 1.5 to 8.5 μm. If exceeding 15 μm, the appearance of the nap-finished artificial leather is adversely affected, for example, the color of surface naps may be uneven and the smoothness of touch may be deteriorated. If less than 1.0 μm, the appearance and surface properties are adversely affected in total, although densified napped feel is obtained. For example, the color of surface naps may be whitish and the surface abrasion resistance such as pilling resistance may be reduced.

If the mass per unit area or thickness of the obtained web of filaments is insufficient, they are regulated to a desired level by lapping or by superposing two or more web of filaments. The lapping is made by supplying a web of filaments in the direction perpendicular to the flow direction of process and folding it nearly in its width direction, or by supplying a web of filaments in the direction parallel to the flow direction of process and folding it in its length direction. When the shape stability of nonwoven fabric made of sea-island fibers or the denseness of fibers is insufficient or when the orientation of sea-island fibers in the nonwoven fabric is controlled, the mechanical entangling treatment is performed by a known method such as needle punching. By the entangling treatment, the fibers in the web of filaments and the fibers in the boundary between the adjacent layers of lapped or superposed web of filaments are three-dimensionally entangled. The entangling treatment by needle punching is performed by suitably selecting the treatment conditions such as kind of needle (shape and gauge of needle, shape and depth of barb, number and position of barb, etc.), punching density (the punching number per unit area expressed by the product of the density of needle on a needle board and the number of stroking the needle board per unit area of web of filaments), and needle-punching depth (the degree of penetration of needle into the web of filaments).

Although the kind of needle may be the same as those used in the known production of artificial leather using staple fibers, the needles of the type mentioned below are preferably used because the gauge of needle, the depth of barb and the number of needles are particularly important for obtaining the effects of the present invention.

The gauge of needle is a factor affecting the denseness or surface quality to be obtained after the treatment. At least the blade portion (the tip portion of needle where barb is formed) is needed to be smaller (thinner) than the size #30 (the height if the cross section is a regular triangle or the diameter if the cross section is circular is about 0.73 to 0.75 mm), preferably #32 (about 0.68 to 0.70 rain) to #46 (about 0.33 to 0.35 mm), and more preferably #36 (about 0.58 to 0.60 mm height) to #43 (about 0.38 to 0.40 mm). A needle having a blade portion with a size larger (thicker) than #30 is highly flexible in selecting the shape and depth of barb and preferred in view of the strength and durability on one hand, but it leaves needle-punching marks with a large diameter on the surface of nonwoven fabric on the other hand, thereby making it difficult to obtain the dense fiber assemblies and surface quality aimed in the present invention. In addition, since the frictional resistance between the fibers in the web of filaments and the needles becomes excessively large, an excess amount of oil agent for needle-punching treatment is unfavorably needed. A needle having a blade portion with a size smaller than #46 is not suitable for industrial production in view of the strength and durability and makes it difficult to use a barb depth preferred in the present invention. In view of easily catching the fibers and reducing the frictional resistance, the cross-sectional shape of the blade portion is preferably a regular triangle.

The barb depth referred to herein is the height from the deepest portion of barb to the tip of barb. In barbs with a general shape, the barb depth is the total of the height (kickup) of the tip of barb outwardly projecting from the side of needle and the depth (throat depth) of the depressed portion on the side of needle. The barb depth is equal to or more than the diameter of sea-island fibers and preferably 120 μm or less. If smaller than the diameter of sea-island fibers, the sea-island fibers are hardly caught by the barb. If exceeding 120 μm, although the sea-island fibers are extremely easily caught by the barb, needle-punching marks with a large diameter are likely formed on the surface of nonwoven fabric body, thereby making it difficult to obtain the dense fiber assemblies and surface quality aimed in the present invention. The barb depth is preferably from 1.7 to 10.2 times, more preferably from 2.0 to 7.0 times the diameter of sea-island fibers. If less than 1.7 times, the effect of entanglement corresponding to an increased punching number described below is not obtained in some cases, provably because the sea-island fibers are hardly caught by barb. If exceeding 10.2 times, the damage such as breaking and cracking of sea-island fibers tends to increase rather than the sea-island fibers come to be easily caught by barb.

The number of barbs is suitably selected from 1 to 9 so as to obtain the effect of entanglement. To obtain a nonwoven fabric with a dense structure intended in the invention, the needle mainly used in the entangling treatment by needle-punching, i.e., the needle used for the punching of 50% or more of the punching number mentioned below is required to have six barbs. The numbers of barbs of needles used in the entangling treatment by needle punching are not necessarily the same, and needles having different numbers of barbs, for example, needles having one barb and needles having six barbs, needles having three barb and needles having six barbs, needles having six barbs and needles having nine barbs, needles having one barb, needles having six barbs and needles having nine barbs, etc. may be used combinedly and used in a given order. In a needle having two or more barbs, the barbs may be positioned at different distances from the tip thereof or some of the barbs may be positioned at the same distance from the tip. An example of the latter type of needle has a blade portion having a cross-sectional shape of regular triangle and barbs on the respective three vertexes at the same distance from the tip. The former type of needle is mainly used in the present invention for the entangling treatment. A needle having barbs at the same distance from the tip looks to have a thicker blade portion and the barb depth is large. Although a large effect of entanglement is obtained by such a needle, it has significant disadvantages caused by the thick blade portion and the excessively large barb depth. In addition, when the needle-punching treatment is carried out severely using the latter type of needles, the portion where many fibers (ten or more fibers to tens of fibers) are oriented in a group along the thickness direction of nonwoven fabric excessively increases. Therefore, the dense structure aimed in the present invention tends to be difficult to obtain. Namely, the number of fibers oriented nearly parallel to a cross section which is taken along the thickness direction of nonwoven fabric increases, but the existence density of fibers nearly perpendicular to the cross section tends to significantly decrease. Since a large effect of entanglement is obtained even when the punching number is small, the latter type of needles may be preferably used partly in the entangling treatment. For example, in one of preferred embodiments, the entangling treatment is carried out using the latter type of needles at any stage between the initial stage and the middle stage of the entangling treatment in a degree not adversely affecting the aimed dense structure, and then, carried out using the former type of needles to obtain the aimed dense structure. In the present invention, "the number of barbs" is the total of the barbs at the needle tip portion which penetrate through the nonwoven fabric and the barbs which do not penetrate through the nonwoven fabric but substantially take part in the entanglement. The barb not taking part in the entanglement is not counted in the number of barbs. For example, if the needle punching is conducted by using needles having nine barbs under an entangling condition where three barbs are left outside the nonwoven fabric at the deepest punching, substantially the same effect is obtained as in the needle punching using needles having six barbs.

The total number of needle punching is preferably from 800 to 4000 puch/cm$^2$ and more preferably from 1000 to 3500 punch/cm$^2$. When the needles having barbs at the same distance from the tip are used, the total number of needle punching is about 300 punch/cm$^2$ or less, and preferably 10 to 250 punch/cm$^2$. In this case, when the total number of needle punching exceeds 300 punch/cm$^2$, many fibers are oriented in the thickness direction and the existence density of nonwoven fabric may be difficult to increase even when subjected to an additional needle punching using another type of needles, a shrinking treatment or a press treatment. If the total number of needle punching is less than 800 punch/cm$^2$, the densification is insufficient and the fibers in different webs of filaments may be likely not entangled sufficiently to unite the nonwoven fabric loosely. If exceeding 4000 punch/cm$^2$, although depending upon the shape of needles, the damage of fibers such as breaking and cracking by needles becomes remarkable. When the fibers are damaged severely, the shape stability of nonwoven fabric is drastically reduced and the denseness may be rather lowered in some cases.

In view of the mechanical properties such as shape stability and tear strength of the resulting nonwoven fabric and substrate for artificial leather and the orientation of the fibers in the thickness direction, it is preferred to allow the barbs of needles to act as much as possible on the web of filaments throughout its thickness. Therefore, the needle punching depth is preferably set so that the barb nearest the tip of needle penetrates through the web of filaments. Particularly in the needles having six barbs essentially used in the invention, it is important not to allow all the barbs to penetrate through in order to obtain the entanglement effect intended in the invention at its highest. Namely, the needle punching is conducted in a punching depth so that the barb most distant from the tip is retained in the web of filaments. If all the barbs are allowed to penetrate through, the filaments caught by six barbs are pushed out of the web of filaments, thereby failing to obtain the densified structure intended in the invention. It is preferred to allow 2 to 5 barbs, more preferably 3 or 4 barbs not to penetrate through the web of filaments. To achieve the dense structure not obtained ever, the punching of 50% or more, preferably 70% or more of the punching number are performed in a punching depth which allows the barb nearest the tip end of needle to penetrate through the web of filaments. If the punching depth is excessively large, the dense structure is not obtained even when needles having six barbs are used as described above, and also, the damage of fibers due to barbs may become remarkable, the fibers may be broken in extreme cases, and punching marks may be left on the surface of nonwoven fabric even when the number of barbs is 1, 2, 8, 4, 5, 7, 8, 9 or 10 or more, i.e., without depending upon the number of barbs. Therefore, the needle-punching conditions should be selected by taking these problems into consideration.

To prevent the fibers from being damaged or broken by the needle punching treatment and avoid the electrification and generation of heat due to strong friction between needles and fibers, an oil agent is preferably added to the web of filaments at any stage after the production of web of filaments and before the entangling treatment. The oil agent is added by a known coating method such as spray coating, reverse coating, kiss roll coating and lip coating, with the spray coating being most preferred because it is in non-contact with the web of filaments and an oil agent having a low viscosity which penetrates into the inside of web of filaments quickly can be used. The words "after the production of web of filaments" referred above means the stage after the melt-spun sea-island fibers are collected and piles on a collecting surface such as moving net. The oil agent to be added before the entangling treatment may comprise a single kind of component. Two or more kinds of oil agents having different effects may be also used in mixture or separately. The oil agent having a high lubricating effect which reduces the friction between needles and fibers, i.e., the friction between metal and polymer is used in the present invention. Examples thereof include mineral oil agents and polysiloxane oil agents, preferably an oil agent mainly comprising dimethylsiloxane. When a highly lubricant polysiloxane oil agent is used, the entangling effect by catching the fibers on barbs may be partly significantly reduced due to an excessively high lubricating effect, or the entangled state may be difficult to keep because of a significant lowering in the friction coefficient between fibers. To prevent these drawbacks, an oil agent having a high friction effect such as a mineral oil agent is preferably used in combination. Since in the present invention the water-soluble polymer is used as the sea component of sea-island fibers and the sea-island fibers are converted to microfine fiber bundles by using water or an aqueous solution, the polysiloxane oil agent is not removed in the conversion to the microfine fiber bundles and a substantial part thereof may remain on the microfine fibers and the elastic polymer. Therefore, when the resulting substrate for artificial leather is used for the production of a suede-finished artificial leather, the remaining oil agent causes unevenness such as uneven dyeing during the dyeing treatment in bath, or the oil agent not completely removed and still remaining after the finishing treatment such as the treatment in bath reduces the fixation of the napped fibers to the nonwoven fabric to likely form fiber pills. Therefore, these drawbacks should be taken into consideration when the polysiloxane oil agent is used. In addition to the combined use of the mineral oil agent and the polysiloxane oil agent, a surfactant such as a polyoxyalkylene surfactant is preferably used as an antistatic agent when the electrification due to friction is remarkable.

The nonwoven fabric comprising the sea-island fibers is finally required to have an average existence density (the number of the fibers which are nearly perpendicular to a cross section of the nonwoven fabric taken along the thickness direction per unit area of the cross section) of 1000 to 3500/mm$^2$, preferably 1100 to 3000/mm$^2$, and more preferably 1200 to 2500/mm$^2$. To obtain a dense structure having such a range of average existence density, a heat-shrinking treatment by hot air, hot water or steam is combinedly conducted after the entangling treatment such as needle punching. By one of these treatments of the combination of two or more of these treatments, the dense structure intended in the invention is finally obtained. A press treatment is preferably employed in addition to the entangling treatment and the shrinking treatment. When the press treatment is combined with the entangling treatment, the press treatment may be conducted before or after the entangling treatment, or the entangling treatment may be conducted simultaneously with the press treatment. When the press treatment is combined with the shrinking treatment, the press treatment may be conducted before or after the shrinking treatment. However, it is not recommended to conduct the shrinking treatment simultaneously with the press treatment, because uneven shrinking is caused.

In the invention, the heat-shrinking treatment after the needle punching treatment is conducted under a moist heat condition. The moist heat treatment is a treatment of heat-shrinking the nonwoven fabric after the entangling treatment by needle punching in a high-temperature, high-humidity atmosphere so that a desired denseness is obtained. To obtain a nonwoven fabric having a denseness expressed by an average existence density of about 800 to 1100/mm$^2$, for example, the web of filaments is first densified to an average existence density of about 350 to 750/mm$^2$ by the needle punching treatment and then further densified to a desired level by the heat shrinking treatment. It is required for the heat-shrinking treatment that the web of filaments is constituted from the sea-island fibers containing a heat-shrinkable component. In addition, a web of filaments which is made of another type of shrinkable fibers in combination with the sea-island fibers is preferably used and it is also preferred to superpose a shrinkable web which is separately produced on the web of filaments. The heat-shrinkable sea-island fibers are produced by spinning a material in which the sea component polymer and/or the island component polymer is a heat-shrinkable polymer. In the present invention, at least the island component polymer comprises the heat-shrinkable polymer mentioned above. The conditions for the moist heat-shrinking treatment are not particularly limited as long as the island component polymer sufficiently shrinks and the sea component polymer is swelled and plasticized but not dissolved out, and suitably selected depending upon the method of the heat-shrinking treatment and the amount of the product to be treated. For example, preferred are a method in which the nonwoven fabric is introduced into a moist heat atmosphere kept at 65 to 100° C. and a relative humidity of 70 to 100% by continuously supplying saturated water vapor, and a method in which the heat required for shrinking the island component polymer and swelling and plasticizing the sea component polymer is supplied to the nonwoven fabric by any of the following methods after or while supplying water to the nonwoven fabric in an amount enough to swell and plasticize the sea component polymer. The heat is supplied to the water-supplied nonwoven fabric preferably by a method in which the nonwoven fabric is introduced into an atmosphere kept at a desired temperature, a method in which the nonwoven fabric is directly blown with air kept at a desired temperature, and a method in which the nonwoven fabric is heated to a desired temperature by the irradiation of electromagnetic wave such as infrared ray. A nonwoven fabric with a large area is likely to shrink unevenly, affected by the influence of its own weight, etc. To avoid the uneven shrinking, it is preferred to keep the nonwoven fabric at different temperatures from place to place in its lengthwise direction and width direction, thereby controlling the initiation of shrinking and the speed of shrinking.

In addition to the entangling treatment by needle punching and the heat-shrinking treatment, it is preferred, if needed, to subject the nonwoven fabric made of the sea-island fibers to a press treatment prior to the impregnation of elastic polymer mentioned below so as to obtain a desired denseness. For example, a nonwoven fabric having a denseness corresponding to an average existence density of about 1000 to 1200/mm$^2$ is obtained by first densifying the nonwoven fabric so as to reach about 600 to 900/mm$^2$ after the heat-shrinking treatment and then further densifying to a desired level by the press treatment. The press treatment is conducted by pressing the nonwoven fabric after the moist heat-shrinking treatment while being still wet, by pressing the dried nonwoven fabric after the moist heat-shrinking treatment, or by pressing the nonwoven fabric after the moist heat. shrinking treatment while a part of water remains without completely drying. The press treatment is conducted by pressing the nonwoven fabric at a temperature lower than its surface temperature so at to solidify the softened component before the heat by the moist heat-shrinking treatment and drying treatment is lost, or by pressing the nonwoven fabric at a temperature higher than its surface temperature so as to further soften a component while evaporating the contained water. By these treatments, the densification by the press treatment as well as the densification by the heat-shrinking treatment proceeds nearly simultaneously. Therefore, a more uniform densification than obtained only by the press treatment is obtained and the production efficiency can be enhanced. The combination of the heat-shrinking treatment and the press treatment is more effective for densification, when the sea component polymer in the sea-island fibers constituting the nonwoven fabric has a softening temperature lower than that of the island component polymer by 20° C. or more, preferably 30° C. or more. In case of meeting this requirement, only the sea component polymer in the sea-island fibers is softened or nearly softened by heating from a temperature close to the softening temperature of sea component polymer to a temperature lower than the softening temperature but higher than the shrinking temperature of island component polymer, this increasing the movement freedom of the island component to allow the shrinkable island component polymer to shrink. By pressing the nonwoven fabric after the shrinking proceeds sufficiently and while the temperature of sea component polymer is still not lower than its softening temperature, the nonwoven fabric is compressed more densely, and by cooling it to room temperature, the nonwoven fabric is fixed to a desired denseness. In addition to the densifying effect, the press treatment has an effect of fixing the surface of nonwoven fabric more flat. By making the surface flat, the extremely dense assembly of microfine fiber bundles, which is most important feature of the substrate for artificial leather of the present invention, is more effectively obtained. With such a flat surface of substrate for artificial leather, the grinding amount in a treatment for forming napped fibers by buffing, etc. in the production of nap-finished artificial leather can be reduced. Further, in the production of grain-finished artificial leather, a flat grain layer having a thickness as extremely small as 50 μm or less can be stably formed without heat-pressing or buffing the surface of substrate.

Then, the elastic polymer is impregnated, if required, into the dense nonwoven fabric having an average existence density of 1000 to 3500/mm$^2$ and preferably 1300 to 3000/mm$^2$, before or after removing the sea component polymer. A solution or dispersion of the elastic polymer is impregnated and then the elastic polymer is coagulated by a known dry method or wet method. The impregnation is conducted by various known coating methods such as a dip-nip method in which a treatment comprising a step of dipping the nonwoven fabric in a bath of a solution of elastic polymer and a step of nipping by a press roll, etc. to regulate the impregnated amount to a desired level is performed once or more. Other methods include a bar coating method, a knife coating method, a roll coating method, a comma coating method, and a spray coating method. These methods may be used alone or in combination of two or more.

The elastic polymer to be impregnated into the nonwoven fabric is not specifically limited as long as it is conventionally used in the production of substrate for artificial leather. Examples thereof include polyurethane elastomer, acrylonitrile elastomer, olefin elastomer, polyester elastomer, and acrylic elastomer, with the polyurethane elastomer and the acrylic elastomer being preferred. The polyurethane elastomer is produced by a single-stage or multi-stage polymerization such as melt polymerization, bulk polymerization and solution polymerization of a mixture mainly composed of at least one kind of polymer polyol having an average molecular weight of 500 to 3000 and at least one kind of polyisocyanate in combination with a given molar ratio of at least one kind of low molecular compound having two or more active hydrogen atom such as ethylene glycol and ethylene diamine. The polymer polyol is selected from polyester diol, polyether diol, polyether ester diol, and polycarbonate diol. The polyisocyanate is selected from aromatic diisocyanate, alicyclic diisocyanate and aliphatic diisocyanate such as 4,4'-diphenylmethane diisocyanate, isophorone diisocyanate, and hexamethylene diisocyanate. The content of the polymer polyol component in the polyurethane elastomer is preferably 15 to 90% by mass. Examples of the acrylic elastomer include polymers obtained by the polymerization of at least one kind of soft component, at least one kind of hard component, and at least one kind of crosslinkable component. The soft component is derived from a monomer which can form a homopolymer having a glass transition temperature of −90° C. to −5° C. and is preferably non-crosslinkable. Such monomer is selected, for example, from methyl acrylate, n-butyl acrylate, isobutyl acrylate, isopropyl acrylate, n-hexyl (meth) acrylate, and 2-ethylhexyl (meth)acrylate. The hard component is derived from a monomer which can form a homopolymer having a glass transition temperature of 50 to 250° C. and is preferably non-crosslinkable. Such monomer is selected, for example, from methyl methacrylate, ethyl methacrylate, isopropyl methacrylate, isobutyl methacrylate, cyclohexyl methacrylate, and (meth)acrylic acid. The crosslinkable component is an ethylenically unsaturated monomer selected from crosslinkable, mono- or multifunctional, ethylenically unsaturated monomers and compounds capable of forming a crosslinked structure by the reaction with an ethylenically unsaturated monomer unit in polymer chain, for example, selected from ethylene glycol di(meth) acrylate, triethylene glycol di(meth)acrylate, polyethylene glycol di(meth)acrylate, and 1,4-butanediol di(meth)acrylate. A substrate for artificial leather produced by using the polyurethane elastomer as the main elastic polymer is well balanced in hand and mechanical properties, and also well balanced in hand, mechanical properties and durability. A substrate for artificial leather produced by using the acrylic elastomer is rather not suitable for the production of the nap finished artificial leather, because the acrylic elastomer is less adhesive to the bundles of microtine filaments as compared with the polyurethane elastomer, and therefore, less effective for anchoring the napped fibers during their formation. However, the acrylic elastomer is particularly preferred for the production of the grain-finished artificial leather, because the hand becomes not so hard with increasing amount thereof. A mixture of different kinds of elastic polymers may be impregnated or different kinds of elastic polymers may be separately impregnated. An elastic polymer composition comprising the main elastic polymer and another elastic polymer such as synthetic rubber and polyester elastomer is also usable.

After impregnating the elastic polymer liquid such as solution or dispersion of elastic polymer into the nonwoven fabric body, the elastic polymer is coagulated by a known dry method or wet method, thereby fixing the elastic polymer in the nonwoven fabric body. The dry method includes a general method of fixing the elastic polymer in the nonwoven fabric by drying to remove the solvent or dispersion medium. The wet method is a general method in which prior to removing the solvent or dispersion medium the elastic polymer is temporarily or completely fixed in the nonwoven fabric by treating the nonwoven fabric impregnated with an elastic polymer liquid with a non-solvent or a coagulating agent for the elastic polymer, or by heat-treating the nonwoven fabric impregnated with an elastic polymer liquid containing a heat-sensitive gelling agent, etc. To completely fixing the coagulated elastic polymer, it is preferred to conduct a curing treatment such as a heat treatment after removing the solvent or dispersion medium.

The concentration of the elastic polymer liquid, i.e., the content of the elastic polymer in the elastic polymer liquid is preferably 0.1 to 60% by mass. The elastic polymer liquid may be added with various additives which are widely added to the elastic polymer liquid for the production of known substrate for artificial leather as long as the properties of the finally obtained substrate for artificial leather are not adversely affected. Examples of the additive include colorant such as dye and pigment, coagulation modifier, antioxidant, ultraviolet absorber, fluorescent agent, fungicidal agent, penetrant, antifoaming agent, lubricant, water repellent, oil repellant, thickening agent, bulking agent, curing promotor, foaming agent, and water-soluble polymer such as polyvinyl alcohol and carboxymethylcellulose. The amount of the elastic polymer or elastic polymer composition to be impregnated into the nonwoven fabric is suitably selected according to the mechanical properties, durability and hand required for the intended use. The elastic polymer is used in an amount which gives a mass per unit area of elastic polymer preferably 1 to 80% by mass, more preferably 2 to 60% by mass, and still more preferably 5 to 40% by mass of the mass per unit area of nonwoven fabric made of the microtine fiber bundles when it is taken as 100. If less than 1% by mass, the uniform impregnation of the elastic polymer is difficult to make the distribution of the elastic polymer in the substrate for artificial leather significantly uneven, thereby reducing the quality uniformity of the substrate for artificial leather. If exceeding 80% by mass, the hand of the substrate for artificial leather is made remarkably hard and strongly rubbery, because the nonwoven fabric is excessively densified.

The sea component polymer is removed from the sea-island fibers constituting the nonwoven fabric before or after impregnating the elastic polymer by treating the nonwoven fabric with a liquid which is a non-solvent or non-decomposing agent for the island component polymer, and a non-solvent or non-decomposing agent for the elastic polymer when removing after impregnating the elastic polymer, but a solvent or decomposing agent for the sea component polymer. When the sea component polymer is a water-soluble polymer such as polyvinyl alcohol mentioned above, hot water heated to a temperature capable of resolving the polymer is used. When the sea component polymer is the easy alkali-decomposable modified polyester copolymerized with an alkali metal sulfonate mentioned above, an aqueous solution of an alkaline decomposer such as an aqueous solution of sodium hydroxide is used at suitable temperatures. By such a treatment for removing the sea component polymer, the sea-island fibers are converted to the microfine fiber bundles made of the island component polymer, to obtain the substrate for artificial leather of the present invention which preferably has a mass per unit area of 300 to 1800 g/m$^2$.

In addition to the differences mentioned above, the substrate for artificial leather obtained by converting the sea-island fibers to the bundles of microfine filaments is critically different from a known substrate for artificial leather in that the size of gaps between the bundles of microfine filaments is as extremely small as 70 μm or less, preferably 60 μm or less, and the size of gaps is uniform. This may be considered a synergetic effect of the following factors in the production of the three-dimensionally entangled nonwoven fabric from assembly of spun sea-island fibers:

(1) The nonwoven fabric does not unnecessarily become bulky before made into the substrate for artificial leather, because the sea-island fibers having a cross-sectional area of about 350 μm or less (corresponding to a fiber diameter of about 21 μm or less) and the number of islands enough to prevent the flattening are spun and the spun sea-island fibers are directly made into a web without cutting;

(2) The web of filaments is three-dimensionally entangled mainly by needle punching using needles with six barbs while allowing the barbs to penetrate through the web in the thickness direction. Such a needle punching is considered to allow the densification and the three-dimensional entanglement to proceed in extremely good balance, thereby providing a random, continuous distribution of a single fiber in a wide range, which is specific to the nonwoven fabric made of filaments. Therefore, the fibers are closely assembled in sufficiently high existence density on a cross section of the nonwoven fabric body;

(3) The water-soluble polymer and the heat-shrinkable polymer are combinedly used as the components for the sea-island fibers and the heat-shrinking treatment is conducted in a moist-heat atmosphere. Therefore, during the densification of the nonwoven fabric by heat shrinking, the island component can shrink to nearly the ideal level because of the rapid swelling and plasticization of the sea component, and the fiber diameter of the island component can be increased to nearly the ideal level by the shrinking. As a result thereof, the sea-island fibers shrink easily along the fiber axis, thereby avoiding the problems found in a known technique such as the random movement of the sea-island fibers during shrinking and the loosening of closely assembled sea-island fibers due to the random movement; and (4) Since the sea component is removed by dissolution in water which is porous and small in molecular size as compared with solvents conventionally used, the solvent molecules disperse into the sea component polymer relatively rapidly. In addition, the sea component polymer is stable from its swelling to dissolution, and a pressure and mechanical force for continuously removing the dissolved sea component polymer from the nonwoven fabric are needed not so much. Therefore, the dissolved sea component is easily removed without increasing the size of gaps between the microfine fiber bundles, although the nonwoven fabric of the invention is significantly densified as compared with those conventionally known.

It is preferred to apply a solution, aqueous dispersion or melt of an easily extractable polymer on the surface of the substrate for artificial leather which will form the upper surface of the resulting artificial leather product, and then, allow the easily extractable polymer to coagulate. The substrate for artificial leather thus treated is suitable for the production of a nap-finished artificial leather having more uniform size of gaps between the microfine fiber bundles and more densified appearance, and a grain-finished artificial leather having finer bent wrinkles. The production method of the invention may further include a step of applying an aqueous dispersion of an elastic polymer on the surface which will form the upper surface of the resulting artificial leather product and then coagulating the elastic polymer and a step of removing the easily extractable polymer by dissolution if it is provided in advance. By such a treatment, a nonwoven fabric more densified than ever known and a more fiat, smooth and uniform napped surface are obtained by the subsequent buffing treatment. By the subsequent grinding treatment under pressure of the surface provided with the elastic polymer, the region from the original surface to a depth of 20 to 200 μm is removed by grinding, and the nonwoven fabric structure from the ground surface to a depth of about 100 to 300 μm is densified much more. The upper or lower surface of the substrate for artificial leather may be made flat and smooth by a buffing treatment or a calender treatment before providing the elastic polymer on the surface thereof as mentioned above. The substrate for artificial leather thus obtained has a surface made flat and smooth by the grinding treatment as well as an extremely uniform denseness which is expressed by a narrow range (10 to 40 μm) of size of gaps between the microfine fiber bundles existing in the region from the surface to a depth of 200 μm.

Examples of the easily extractable polymer include polyvinyl alcohol, polyurethane elastomer, acrylic elastomer, polyethylene glycol, paraffin wax, and polyethylene wax. The elastic polymer is selected from the above examples of the elastic polymer to be impregnated into the nonwoven fabric body, such as polyurethane elastomer and acrylic elastomer. The easily extractable polymer and the elastic polymer may be applied by a known coating method such as a gravure roll coating method, a rotary screen coating method, a spray coating method, and a reverse roll coating method, with the gravure roll coating method being preferred in view of the balance between the viscosity of liquid to be applied and the applying amount. The grinding treatment is conducted, for example, by buffing using sandpaper. The pressure applied onto the sandpaper is suitably set to an optimum level according to the state of surface of the substrate for artificial leather and the state of cross section of treated substrate for artificial leather.

Like the production of known artificial leather, the thickness of the substrate for artificial leather thus produced is, if needed, regulated by slicing the substrate in two or more sheets and grinding the surface which will form the back of final product. Also, one or both surfaces may be treated with a liquid containing a solvent for the elastic polymer or microfine fiber bundles. Thereafter, by raising at least the surface which will form the top of final product by a buffing treatment, etc., a napped surface mainly comprising the microfine fibers is formed, thereby obtaining suede or nubuck nap-finished artificial leather. In addition, grain-finished artificial leather are obtained by forming a cover layer made of the elastic polymer on the top surface.

To form the napped surface, any of known methods such as a buffing treatment using sandpaper or a card clothing and a brushing treatment may be used. Before or after the napping treatment, the surface to be napped or the napped surface may be coated with a solvent capable of dissolving or swelling the elastic polymer or the microfine fiber bundles, for example, a treating liquid containing dimethylformamide (DMF) when the elastic polymer is polyurethane elastomer or a treating liquid containing a phenol compound such as resorcine when the microfine fiber bundles are made of the polyamide resin. With this treatment, the binding degree of microfine fiber bundles by the adhesion of the elastic polymer to the microfine fiber bundles, the length of napped microfine fibers of nap-finished artificial leather and the surface abrasion resistance can be adjusted finely.

The cover layer comprising an elastic polymer is formed by any of the known methods such as a method in which a liquid containing the elastic polymer is directly coated on the surface of substrate for artificial leather and a method in which the liquid is coated on a supporting substrate such as a releasing paper to form a film and then the film is bonded to the substrate for artificial leather. The elastic polymer for forming the cover layer may be a known elastic polymer for use in forming the cover layer of known grain-finished artificial leather, for example, selected from the elastic polymers mentioned above to be impregnated into the nonwoven fabric body. The thickness of cover layer is not particularly limited, and may be about 300 μm or less because grain-finished artificial leather sufficiently balanced with the substrate for artificial leather of the present invention with respect to hand are obtained. When producing grain-finished artificial leather having an extremely flat, smooth, uniform surface layer which can be achieved by the dense assemblies of the microfine fiber bundles, i.e., the most important feature of the substrate for artificial leather of the present invention, the thickness of cover layer is about 100 μm or less, preferably about 80 μm or less, and more preferably from about 3 to 50 μm. With the cover layer having such a thickness, grain-finished artificial leather having extremely fine bent wrinkles resembling natural leather are also produced.

It is preferred to dye the nap-finished artificial leather and grain-finished artificial leather in any stage after converting the sea-island fibers to bundles of microfine filaments. In the present invention, any of dyeing methods using a dye suitably selected according to the kind of fibers and a known dyeing machine generally used for dyeing known artificial leather may be used. Examples of dye include disperse dye, reactive dye, acid dye, metal complex dye, sulfur dye, and sulfur vat dye. Examples of dyeing machine include padder, jigger, circular, and wince dyeing machines. In addition to dyeing, if necessary, a finishing treatment may be preferably employed, which includes a mechanical crumpling treatment in dry state, a relaxing treatment in wet state using a dyeing machine or washing machine, a softening treatment, a functionalizing treatment using softening agent, flame retardant, antimicrobial agent, deodorant, water-oil repellant, etc., a treatment for improving touch using silicone resin, treating agent containing silk protein, grip-improving resin, etc., and a treatment for enhancing appearance by coating colorant or resin other than those mentioned above such as enameling coating resin. Since the microfine fiber bundles in the substrate for artificial leather of the present invention are highly, densely assembled, the hand is significantly improved by the relaxing treatment in wet state and the softening treatment. Therefore, these treatments are preferably employed in the production of grain-finished artificial leather. For example, artificial leather having soft feeling and fullness closely resembling natural leather are produced by the relaxing treatment in water containing a surfactant at about 60 to 140° C. without deteriorating dense feeling attributable to the dense structure.

EXAMPLES

The present invention will be described in more detail with reference to the following examples. However, it should be noted that the scope of the present invention is not limited thereto. In the following, "part(s)" and "%" are based on mass unless otherwise noted.

(1) Cross-Sectional Area of Sea-Island Fiber and Bundle of Microfine Filaments, Number of Bundled Fibers, and Flatness The cross-section taken parallel to the thickness direction of a sample was observed under a scanning electron microscope (magnification of about 100 to 300), and 20 sea-island fibers or bundles of microfine filaments which were oriented nearly perpendicular to the cross section were randomly and evenly selected from the observing field. The number of bundled fibers, the flatness and the projected size of each selected sea-island fiber and microfine fiber bundle were obtained, if needed, after magnifying 1000 to 3000 times. The flatness of fiber or bundle is defined as a ratio of the length of the longest portion in the cross section and the length in the direction perpendicular thereto. Generally, the longest portion mainly orients to the direction perpendicular to the thickness direction.

Next, the cross-sectional area of each of selected 20 sea-island fibers or microfine fiber bundles were measured. The maximum and minimum cross-sectional areas were cut off and the remaining 18 cross-sectional areas were arithmetically averaged to obtain the cross-sectional areas of the sea-island fiber and the microfine fiber bundle.

The cross-sectional area of the microfine fiber bundle is defined as the area of the region surrounded by the fibers in the periphery of bundle and the tangent line connecting the peripheral fibers. When the number of bundled fibers varied from bundle to bundle, the numbers of bundled fibers of sea-island fiber and microfine fiber bundle were determined in the same manner as in the cross-sectional area, i.e., the maximum and minimum numbers were cut off and the remaining 18 numbers were arithmetically averaged.

(2) Existence Density of Sea-Island Fibers or Microfine Filaments on Cross Section of Substrate for Artificial Leather, Size of Gaps Between Microfine Fiber Bundles, and Average Size of Gaps A cross section of a sample taken parallel to the thickness direction was continuously observed under a scanning electron microscope (magnification of about 100 to 300) in a total observed area of about 0.3 to 0.5 $mm^2$.

The number of the cross sections of sea-island fibers or microfine fiber bundles in the observing field, which were deemed to be nearly perpendicular to the lengthwise direction of fibers or bundles, was counted. The total number was divided by the observed area to obtain the number of the cross sections of sea-island fibers or microfine fiber bundles existing per 1 $mm^2$. This observation was made at least five portions of each sample and the smallest value was employed as the existence density of the sample.

Next, the region not occupied by the cross sections of sea-island fibers or microfine fiber bundles on the same observing field was all deemed to be gaps, and the diameter of the largest circle drawn in gaps so as to be tangent to the cross sections of sea-island fibers or microfine fiber bundles was measured. When the gaps were open to form a broad region, two or more circles were drawn so as not to overlap with each other and the largest diameter of the drawn circles was measured. The size of gaps was not determined in the portion of the observing field where the bundles were closely adhered, except for the case where almost all the bundles were closely adhered throughout the observing field. The bundles apart from each other by the diameter of microfine fiber constituting the bundle or less were regarded as being closely adhered. The measured largest diameter of circles in the observing field was employed as the size of gaps between the microfine fiber bundles in the sample. In addition, the diameters of 20 gaps randomly and evenly selected from the observing filed were measured. The 18 values after cutting off the maximum and minimum values were arithmetically averaged to obtain the average size of gaps between the microfine fiber bundles.

(3) Evaluation of Appearance of Nap-Finished Artificial Leather

A nap-finished artificial leather was visually observed by 5 panelists selected form those skilled in artificial leather art and evaluated for its appearance according to the following ratings. The result is shown by the rating given by most of panelists.

A: Extremely highly dense throughout napped surface and smooth touch with no roughness.

B: Slightly less dense throughout napped surface or partially rough although relatively highly dense throughout napped surface, and relatively rough touch.

C: Rough throughout napped surface and considerably rough touch.

(4) Evaluation of Hand of Nap-Finished Artificial Leather

A nap-finished artificial leather was made into a golf glove by sewing when the thickness was less than 0.8 mm, a jacket by sewing when the thickness was 0.8 to 1.2 mm, and a sofa by sewing when the thickness exceeded 1.2 mm. Each product was subjected to wear trial and evaluated for the hand of the nap-finished artificial leather by 5 panelists selected form those skilled in artificial leather art according to the following ratings. The result is shown by the rating given by most of panelists.

A: Soft hand with fullness combined with sufficient dense feeling, and good fit feeling of product.

B: Unsatisfied hand lacking in any of soft feeling, fullness and dense feeling, and insufficient fit feeling of product (same as general nap-finished artificial leather with respect to hand and fit feeling).

C: Extremely poor in any or all of soft feeling, fullness and dense feeling, and poor fit feeling (inferior to general nap-finished artificial leather with respect to hand and fit feeling).

(5) Evaluation of Surface Abrasion Resistance of Nap-Finished Artificial Leather The surface of a nap-finished artificial leather was abraded according to Martindale abrasion test of JIS L1096 under a load of 12 kPa and the number of abrasion of 50000 times. When the difference in mass (abrasion loss) before and after the test was 50 mg or less, the abrasion resistance was judged good. The variation of pilling on the surface of nap-finished artificial leather before and after the test was visually observed and evaluated by the following ratings. When the abrasion resistance was good and the pilling resistance was A or B, the surface abrasion resistance was judged good.

A: No increase in pilling (decrease in pilling by cutting of napped fibers is allowable).

B: Slight increase in piling but no increase in bard pilling.

C: Noticeable increase in pilling and noticeable increase in hard pilling.

Example 1

An ethylene-modified polyvinyl alcohol (ethylene unit: 8.5 mol %; polymerization degree: 380; saponification degree: 98.7 mol %) as the sea component polymer and isophthalic acid-modified polyethylene terephthalate (isophthalic acid unit: 6.0 mol %) as the island component polymer were separately melted. Then, the molten polymers were fed into a composite-spinning spinneret. The spinneret was provided with a number of nozzles arranged in parallel and capable of forming a cross section in which 25 islands of island component polymer having a uniform cross-sectional area were distributed in the sea component polymer. The molten polymers were fed into the spinneret in a pressure balance which regulated the average areal ratio of the sea component polymer and the island component polymer on the cross sections to sea/island=25/75 and the fed polymers were extruded from nozzles at a spinneret temperature of 250° C. The extruded polymers were made thinner by pilling using an air jet-nozzle type sucking apparatus by which the pressure of air jet was regulated so as to obtain an average spinning speed of 3600 m/min, thereby spinning sea-island fibers having an average cross-sectional area of 177 $\mu m^2$ (about 2.4 dtex). The sea-island fibers were continuously collected on a net while sucking from the back side. The pile amount of the sea-island fibers was controlled by changing the moving speed of net. The sea-island fibers collected on the net were pressed by an emboss roll kept at 80° C. at a line pressure of 70 kg/cm, to obtain a web of filaments having an average mass per unit area of 30 $g/m^2$. On a cross section parallel to the thickness direction of the obtained web of filaments, the cross sections of sea-island fibers existed in a density of 220 to 250/$mm^2$. The shape of the web of filaments was stabilized enough to wind up.

An oil agent mainly comprising a mineral oil-based lubricating oil agent additionally mixed with an antistatic agent was sprayed on to the surface of the embossed web of filaments. The web of filaments was then continuously lapped using a cross-lapper to obtain a 14-layered web of filaments. The layered web of filaments was three-dimensionally entangled by a needle punching method to obtain a nonwoven fabric having an existence density of sea-island fibers of 500/mm$^2$. First, the lapped web of filaments was preliminarily entangled using needles A (needle gauge #40, 40 μm barb depth, one barb, regular triangle cross section) from both sides thereof at a punching depth of allowing the barb to penetrate through the web in the thickness direction, to obtain a web of filaments which was entangled enough to keep the layers in position. Then, the lapped web of filaments was further entangled using needles B (needle gauge #42, 40 μm barb depth, six barbs, regular triangle cross section) from both sides thereof at a punching depth of allowing three barbs to penetrate through the web in the thickness direction, thereby entangling the sea-island fibers in the thickness direction in a desired degree. The punching density by needles B was 1700 punch/cm$^2$ in total of both sides.

Immediately after uniformly spraying water of 18° C. on both sides, the nonwoven fabric is subject to the moist heat-shrinking treatment by continuously passing it through an atmosphere kept at 76° C. and a relative humidity of 95% over four minutes under conditions substantially free from tension and friction in both the lengthwise and widthwise directions, thereby uniformly compacting the space between the sea-island fibers. Thereafter, the nonwoven fabric was pressed between metal rolls kept at 120° C. for drying while compressing and flattening the surface, and then, the whole part of the nonwoven fabric was introduced into an atmosphere of 120° C. for drying, thereby obtaining a densified nonwoven fabric having a mass per unit area of 1125 g/m$^2$. On a cross section parallel to the thickness direction of nonwoven fabric body, the existence density of sea-island fibers was 1900/mm$^2$.

The obtained nonwoven fabric was impregnated with an elastic polymer liquid, i.e., an aqueous dispersion (solid concentration: 11% by mass) of polyurethane composition mainly composed of a polycarbonate ether-based polyurethane. The nonwoven fabric was pressed between metal rolls so as to regulate the content of the elastic polymer liquid to 50 by mass per 100 by mass of nonwoven fabric body, and then, exposed to an infrared heater for one minute to heat the surface of the nonwoven fabric to 80° C., thereby heat-coagulating the elastic polymer. Finally, the nonwoven fabric was introduced into an atmosphere of 120° for drying, and immediately thereafter, introduced into an atmosphere of 150° C. for curing for two minutes, thereby allowing the polyurethane composition to exist in the space between the sea-island fibers. Then, the modified polyvinyl alcohol was removed from the sea-island fibers by extraction in a jet dyeing machine by hot water of 90° C. for 20 min and the nonwoven fabric was introduced into an atmosphere of 120° C. for drying, thereby obtaining a substrate for artificial leather of about 1.4 mm thick comprising a nonwoven fabric constituted by bundles of microfine filaments of polyethylene terephthalate and the polyurethane composition impregnated therein.

On a cross section of the obtained substrate for artificial leather, the cross-sectional area of the bundles of microtine filaments ranged from 200 to 400 μm$^2$ and was 250 μm$^2$ in average and the fiber diameter was nearly uniform. Each bundle had 25 microfine filaments having a cross-sectional shape of nearly circle. The bundles were not so flattened in the thickness direction, and the flatness of bundle was 2.5 at the largest and less than 2.0 for most of the bundles. The projected size was 40 μm. The existence density of bundles of microfine filaments on a cross section parallel to the thickness direction was 2500/mm$^2$, the gaps between the microfine fiber bundles had a size of 52 μm, and the average size of gaps was 35 μm.

Example 2

The substrate for artificial leather obtained in Example 1 was sliced to two parts in the thickness direction, and the divided surface was buffed with sandpaper to regulate the average thickness to 0.67 mm. The other surface not buffed was coated with a 6% aqueous solution of polyvinyl alcohol twice by a 55-mesh gravure roll, and then dried, and then, coated with an aqueous dispersion (solid concentration: 6% by mass) of polyurethane composition mainly composed of the same polycarbonate ether-based polyurethane as in Example 1 three times by a 75-mesh gravure roll and then dried. The surface coated with the polyurethane composition was napped by buffing using an endless sandpaper set on a buffing machine and the napped fibers were ordered, thereby forming naps of microfine fibers made of the modified polyethylene terephthalate. After dyeing with a disperse dye in a jet dyeing machine, the napped fibers were ordered by brushing, to form a beige nap-finished artificial leather. On the cross section of the nap-finished artificial leather, the existence density of microfine fiber bundles in the region from the napped surface to a depth of 200 μm was 2700/mm$^2$. The nap-finished artificial leather had the effects intended in the present invention, i.e., an extremely high denseness, an elegant nap appearance resembling that of natural nubuck leather as well as an excellent hand and surface abrasion resistance. The results of evaluation are shown in Table 1.

Comparative Example 1

A web of filaments having a mass per unit area of 30 g/m$^2$ stabilized by embossing was obtained in the same manner as in Example 1 except for using Nylon 6 as the island component polymer of the sea-island fibers for constituting the web of filaments and spinning the sea-island fibers under the condition of producing the fibers having an average cross-sectional area of 307 μm$^2$ (about 3.6 dtex). After providing the surface with the oil agent as in Example 1, the web of filaments was lapped by a crosslapper to obtain a layered web of filaments. The layered web of filaments was preliminarily entangled using needles A in the same manner as in Example 1, and then, entangled using needles C (needle gauge #42, 40 μm barb depth, one barb, regular triangle cross section) from both sides thereof at a punching depth of allowing the barb to penetrate through the web in the thickness direction, thereby entangling the sea-island fibers in the thickness direction. The punching density was 3500 punch/cm$^2$ in total of both sides. The obtained nonwoven fabric was subjected to the moist heat treatment and the press treatment in the same manner as in Example 1, to obtain a nonwoven fabric having a mass per unit area of 700 g/m$^2$.

The polyurethane composition was allowed to exist in the space between the sea-island fibers of the obtained nonwoven fabric in the same manner as in Example 1, and the modified polyvinyl alcohol was removed from the sea-island fibers by extraction, to obtain a substrate for artificial leather of about 1.4 mm thick comprising a nonwoven fabric constituted by bundles of microfine filaments of Nylon 6 and the polyurethane composition impregnated therein. The obtained substrate for artificial leather was made into a beige nap-finished artificial leather in the same manner as in Example 2 by slicing to two parts, buffing, forming napped fibers of Nylon 6 microfine fibers, dyeing with a metal complex acid dye in a jet dyeing machine to the same color as in Example 2, and finished by ordering. The obtained nap-finished artificial leather was insufficiently densified and merely had a coarse nap appearance which had been achieved by a known suede-finished artificial leather. The surface abrasion resistance was not so good and the hand was hard and bony. Thus, the properties obtained did not reach the level intended in the present invention. The results of evaluation are shown in Table 1.

Comparative Example 2

A web of filaments having a mass per unit area of 30 g/m$^2$ stabilized by embossing was obtained in the same manner as in Example 1 except for spinning the sea-island fibers for forming the web of filaments using a composite-spinning spinneret capable of forming a cross section in which 100 islands of island component polymer were distributed in the sea component polymer. After coating the surface with the oil agent as in Example 1, the obtained web of filaments was made into a layered web of filaments by a crosslapper and entangled by the needle punching as in Example 1. The obtained nonwoven fabric was hot-pressed without coating water, to obtain a nonwoven fabric having a mass per unit area of 970 g/m$^2$.

The polyurethane composition was allowed to exist in the space between the sea-island fibers of the obtained nonwoven fabric in the same manner as in Example 1, and the modified polyvinyl alcohol was removed from the sea-island fibers by extraction, to obtain a substrate for artificial leather of about 1.4 mm thick comprising a nonwoven fabric constituted by bundles of microfine filaments of modified polyethylene terephthalate and the polyurethane composition impregnated therein. The obtained substrate for artificial leather was made into a beige nap-finished artificial leather in the same manner as in Example 2 by slicing to two parts, buffing, forming napped fibers of modified polyethylene terephthalate microfine fibers, dyeing with a disperse dye, and finished by ordering. The obtained nap-finished artificial leather superficially looked densified. However, it is no more than that the bundles on the surface portion were flattened by the collapse in the thickness direction to increase the density. Many of the bundles has a flatness exceeding 3.0 and the largest flatness was 4.7. When the surface portion densified by flattened bundles was napped by buffing, the surface portion returned to an insufficiently densified state close to the sparse portion not densified. As a result, only coarse nap appearance which had been achieved by a known suede-finished artificial leather was obtained. In addition, since the central portion in the thickness direction was sparse and only the surface portion was excessively tightly compacted, the hand was hard as in the surface of corrugated paper. Thus, the properties obtained did not reach the level intended in the present invention. The results of evaluation are shown in Table 1. Although dyed in the same manner as in Example 2, the color was whitish without deepness and the appearance lacked quality of high grade, because the microfine fibers forming naps were extremely fine.

Comparative Example 3

A web of filaments having a mass per unit area of 30 g/m$^2$ stabilized by embossing was obtained in the same manner as in Example 1 except for spinning the sea-island fibers for forming the web of filaments using a composite-spinning spinneret capable of forming a cross section in which 64 islands of island component polymer were distributed in the sea component polymer under the condition of producing the fibers having an average cross-sectional area of 485 μm$^2$ (about 6.6 dtex). After providing the surface with the oil agent as in Example 1, the web of filaments was lapped by a crosslapper to obtain a layered web of filaments. The layered web of filaments was preliminarily entangled using needles A and then entangled using needles B in the same manner as in Example 1. The obtained nonwoven fabric was subjected to the moist heat treatment and the press treatment in the same manner as in Example 1, to obtain a nonwoven fabric having a mass per unit area of 990 g/m$^2$.

The polyurethane composition was allowed to exist in the space between the sea-island fibers of the obtained nonwoven fabric in the same manner as in Example 1, and the modified polyvinyl alcohol was removed from the sea-island fibers by extraction, to obtain a substrate for artificial leather of about 1.4 mm thick comprising a nonwoven fabric constituted by bundles of microfine filaments of modified polyethylene terephthalate and the polyurethane composition impregnated therein. The obtained substrate for artificial leather was made into a beige nap-finished artificial leather in the same manner as in Example 2 by slicing to two parts, buffing, forming napped fibers of modified polyethylene terephthalate microfine fibers, dyeing with a disperse dye, and finished by ordering. Since the number of bundles per unit cross-sectional area was sufficient, the obtained nap-finished artificial leather looked densified. However, since the bundles were largely flattened to have a flatness exceeding 4.0, the size of gaps between the bundles was significantly uneven and gaps having an extremely large size existed in places. Therefore, the obtained nap-finished artificial leather had coarse nap appearance which was no more than that achieved by a known suede-finished artificial leather. The loss of surface abrasion was small but the pilling occurred increasingly. In addition, the hand was slightly stiff and insufficient in bulky feeling. Thus, the properties obtained did not reach the level intended in the present invention. The results of evaluation is shown in Table 1.

Comparative Example 4

A web of filaments having a mass per unit area of 30 g/m$^2$ stabilized by embossing was obtained in the same manner as in Example 1 except for spinning the sea-island fibers for forming the web of filaments under the conditions of regulating the average areal ratio of the sea component polymer and the island component polymer on the cross section to sea/island=20/80 and the average cross-sectional area to 147 μm$^2$ (about 2.0 dtex). After providing the surface with the oil agent as in Example 1, the web of filaments was lapped by a crosslapper to obtain a layered web of filaments. The layered web of filaments was entangled in the same manner as in Example 1. The obtained nonwoven fabric was heat-shrunk by immersing in hot water of 70° C., and then, without drying the modified polyvinyl alcohol was removed from the sea-island fibers by extraction in hot water of 90° C., thereby obtaining a substrate for artificial leather having a mass per unit area of 845 g/m$^2$ which comprised the bundles of microfine filaments of the modified polyethylene terephthalate but did not contain the polyurethane composition.

The obtained substrate for artificial leather was made into a beige nap-finished artificial leather in the same manner as in Example 2 by slicing to two parts, buffing, forming napped fibers of modified polyethylene terephthalate microfine fibers, dyeing with a disperse dye, and finished by ordering. Although not impregnated with the polyurethane composition unlike other examples, the obtained nap-finished artificial leather had favorable hand with firm and dense feeling. However, a portion where the bundles were closely compacted and a portion where the bundles were slightly sparse existed mixedly on the cross section. When buffing such a substrate having the bundles unevenly distributed, a portion with dense naps and a portion with sparse naps, which may be caused by unevenly distributed bundles, existed mixedly on the napped surface. The existence density of bundles of microfine filaments on the cross section parallel to the thickness direction was 1400/mm$^2$ even at the densified portion near the surface. The size of gaps between the microfine fiber bundles was 74 μm and the average size of gaps in the region from the surface to a depth of 200 μm was 42 μm. As a result, the nap appearance was generally coarse and did not reach the level intended in the present invention. The results of evaluation are shown in Table 1.

Comparative Example 5

The ethylene-modified polyvinyl alcohol (removable component) of the same type as used in Example 1 and the isophthalic acid-modified polyethylene terephthalate (fiber-forming component) of the same type as used in Example 1 were separately melted. Then, the molten polymers were fed into a composite-spinning spinneret capable of forming a layered cross section in which five layers of the removable component (corresponding to sea component polymer) and six layers of the fiber-forming component (corresponding to island component polymer) were alternately stacked. A web of filaments having a mass per unit area of 30 g/m$^2$ stabilized by embossing was obtained in the same manner as in Example 1 except for feeding the molten polymers into the spinneret in a pressure balance which regulated the average areal ratio of the removable component and the fiber-forming component to 35/65 and spinning the composite fibers under the conditions of controlling the average cross-sectional area to 330 μm (about 4.4 dtex). After providing the surface with the oil agent as in Example 1, the web of filaments was lapped by a crosslapper to obtain a layered web of filaments. The layered web of filaments was preliminarily entangled using needles A in the same manner as in Example 1, and then, entangled using needles D (needle gauge #32, 60 μm barb depth, nine barbs, regular triangle cross section) from both sides thereof in a total punching density of 600 punch/cm$^2$ at a punching depth of allowing the barbs to penetrate through the web in the thickness direction, thereby entangling the sea-island fibers in the thickness direction (If the punching density exceed 1000 punch/cm$^2$, the trouble such as needle break occurs frequently). The layered web of filaments was further needle-punched using needles E (needle gauge #36, 80 μm barb depth, one barb, regular triangle cross section) at a punching depth preventing the needles from penetrating through the web in the thickness direction in a punching density of 400 punch/cm$^2$. After the needle punching by needles E, the nonwoven fabric was cross-sectionally observed. Many bundles were oriented in the thickness direction and the fiber ends formed by breaking were found in a density of 0.5 to 2.5/mm$^2$ on the surface. The obtained nonwoven fabric was subjected to the moist heat treatment and the press treatment in the same manner as in Example 1, to obtain a nonwoven fabric having a mass per unit area of 650 g/m$^2$.

The polyurethane composition was allowed to exist in the space between the sea-island fibers of the obtained nonwoven fabric in the same manner as in Example 1, and the modified polyvinyl alcohol was removed from the sea-island fibers by extraction, to obtain a substrate for artificial leather of about 1.4 mm thick comprising a nonwoven fabric constituted by bundles of microfine filaments of modified polyethylene terephthalate and the polyurethane composition impregnated therein. The obtained substrate for artificial leather was made into a beige nap-finished artificial leather in the same manner as in Example 2 by slicing to two parts, buffing, forming napped fibers of modified polyethylene terephthalate microtine fibers, dyeing with a disperse dye, and finished by ordering. The obtained nap-finished artificial leather had a cross section which was clearly poor in the denseness of bundles as compared with Example 1. In addition, the size of gaps between the bundles was significantly uneven and gaps having an extremely large size existed in places. Therefore, the obtained nap-finished artificial leather had coarse nap appearance which was no more than that achieved by a known suede-finished artificial leather. The hand was extremely hard and bony. Thus, the properties obtained did not reach the level intended in the present invention. The results of evaluation are shown in Table 1.

TABLE 1

| | | Comparative Examples | | | | |
|---|---|---|---|---|---|---|
| | Example 2 | 1 | 2 | 3 | 4 | 5 |
| Kind of composite fiber | sea-island | sea-island | sea-island | sea-island | sea-island | layered |
| Island component fiber (fiber-forming component) | modified polyethylene terephthalate | Nylon 6 | modified polyethylene terephthalate | modified polyethylene terephthalate | modified polyethylene terephthalate | modified polyethylene terephthalate |
| Sea component (removable component) | modified polyvinyl alcohol | modified polyvinyl alcohol | modified polyvinyl alcohol | modified polyvinyl alcohol | modified polyvinyl alcohol | modified polyvinyl alcohol |
| Number of microfine filaments | 25 | 25 | 100 | 64 | 25 | 6 |
| Cross-sectional area of bundles of microfine filaments (μm$^2$) | 250 | 230 | 160 | 722 | 184 | 270 |
| Flatness of microfine fiber | 2.5 | 2.9 | 4.7 | 4.3 | 2.6 | 3.8 |

TABLE 1-continued

| | Example 2 | Comparative Examples 1 | 2 | 3 | 4 | 5 |
|---|---|---|---|---|---|---|
| bundles | | | | | | |
| Number of cross section of bundles of microfine filaments (per $mm^2$) | 2500 | 1350 | 1900 | 1600 | 1400 | 450 |
| Size of gaps (μm) | 52 | 78 | 74 | 82 | 74 | 107 |
| Denseness and elegance of napped fibers | A | B | B | C | B | C |
| Flexibility and bulky feeling of hand | A | B | C | B | A | C |
| Surface abrasion resistance | A | B | C | C | C | C |
| Abrasion loss (mg) | 8 | 42 | 220 | 25 | 15 | <1 |
| Pilling | A | B | A | C | C | C |

INDUSTRIAL APPLICABILITY

The artificial leather obtained from the substrate for artificial leather of the invention combines good appearance, high surface strength and good hand and suitable for the production of clothes such as jacket, skirt, shirt and coat; shoes such as sport shoes, gentlemen's shoes and ladies' shoes; accessories such as belt; bags such as hand bag and children's backpack; furniture such as sofa and office chair; seats and interiors of vehicles such as passenger car, train, air plane and ship; and gloves such as sport glove, for example, golf glove, batting glove and baseball glove, driving glove and working glove.

The nap-finished artificial leather obtained from the substrate for artificial leather of the invention has highly densified nap appearance resembling that of natural nubuck leather. The nap-finished artificial leather is excellent in color development, hand with both soft, bulky feeling and dense feeling, and surface abrasion resistance such as piling resistance, which are hitherto difficult to combine. The grain-finished artificial leather obtained from the substrate for artificial leather is highly flat and smooth and has appearance resembling the gain surface of natural leather having extremely fine bent wrinkles. The grain-finished artificial leather is also excellent in united feeling between substrate and grain layer, hand with soft and bulky feeling, and peeling strength due to adhesion, which are hitherto difficult to combine. These artificial leather are suitably applied to the use such as clothes, shoes, bags, furniture, car seats and sport gloves such as golf glove.

What is claimed is:

1. A substrate, comprising a nonwoven fabric comprising bundles of microfine filaments, wherein the nonwoven fabric is obtained by removing a sea component from sea-island filaments to convert the sea-island filaments to the bundles of the microfine filaments, such that:

(1) each bundle of microfine filaments comprises 8 to 70 microfine filaments having a nearly circular cross-sectional shape;

(2) each bundle of microfine filaments has a cross-sectional area of 170 to 700 $\mu m^2$ and a flatness of less than 3.0;

(3) on a cross section parallel to a thickness direction of the nonwoven fabric, the number of bundles per area is 1500 to 3000/$mm^2$;

(4) on a cross section parallel to a thickness direction of the nonwoven fabric, gaps between the bundles of microfine filaments have a size of 70 μm or less.

2. The substrate of claim 1, wherein on a cross section parallel to a thickness direction of the nonwoven fabric body, an average size of gaps between the bundles of microfine filaments in a region from a surface to a depth of 200 μm is 10 to 40 μm.

3. The substrate of claim 2, further comprising an elastic polymer.

4. A nap-finished artificial leather obtained by napping a surface of the substrate of claim 3.

5. A nap-finished artificial leather obtained by napping a surface of the substrate of claim 2.

6. The substrate of claim 1, further comprising an elastic polymer.

7. A nap-finished artificial leather obtained by napping a surface of the substrate of claim 6.

8. A nap-finished artificial leather obtained by napping a surface of the substrate of claim 1.

9. The substrate of claim 1, wherein the microfine filaments comprise a heat-shrinkable polymer.

10. A method of producing the substrate of claim 1, the method comprising, sequentially (a) to (d):

(a) melt-spinning sea-island filaments having an island number of 8 to 70, a sea/island cross-sectional area ratio of 5:95 to 60:40 and a cross-sectional area of 70 to 350 $\mu m^2$ with a heat-shrinkable polymer as an island component and a water-soluble polymer as a sea component, and collecting the sea-island filaments, which have been spun, on a collecting surface in random orientations without cutting, thereby producing a sheet-form web of filaments;

(b) after optionally superposing the web of filaments in layers, needle-punching the web of filaments from both sides thereof with at least needles with six barbs while allowing at least one barb to penetrate through the web of filaments, thereby three-dimensionally entangling the sea-island filaments to produce a nonwoven fabric body;

(c) moist heat-treating the nonwoven fabric body to plasticize the sea component polymer and allow the heat-shrinkable polymer to shrink and then optionally pressing the nonwoven fabric under dry heating, thereby densifying the nonwoven fabric such that cross sections of the sea-island filaments exist 1000 to 3500/

$mm^2$ on a cross section parallel to a thickness direction of the nonwoven fabric body; and (d) removing the sea component from the sea-island filaments with water or an aqueous solution, thereby converting the sea-island filaments to bundles of microfine filaments.

11. The method of claim 10, further comprising, sequentially, (e) to (h) after (d):

(e) applying a solution, aqueous dispersion, or melt, of an easily extractable polymer on at least one surface of the nonwoven fabric body and then coagulating the easily extractable polymer;

(f) applying an aqueous dispersion of an elastic polymer on the same surface as the at least one surface of the nonwoven fabric body and then coagulating the elastic polymer;

(g) removing the easily extractable polymer from the nonwoven fabric body; and (h) grinding the at least one surface applied with the elastic polymer under pressure to densify the nonwoven fabric body such that gaps between the bundles of microfine filaments in a region from the ground surface to a depth of 200 μm on a cross section of the nonwoven fabric body parallel to its thickness direction have a size of 10 to 40 μm in average.

12. The method of claim 11, further comprising (i) before or after (d):

impregnating a solution or aqueous dispersion of an elastic polymer into the nonwoven fabric and then coagulating the elastic polymer.

13. The method of claim 10, further comprising (i) before or after (d);

(i) impregnating a solution or aqueous dispersion of an elastic polymer into the nonwoven fabric and then coagulating the elastic polymer.

* * * * *